US010717572B2

(12) United States Patent
Wiles et al.

(10) Patent No.: US 10,717,572 B2
(45) Date of Patent: Jul. 21, 2020

(54) REDUCED SLIP TIE STRAP

(71) Applicant: Wiles Technologies LLC, Palm Beach Gardens, FL (US)

(72) Inventors: Benjamin C. Wiles, Palm Beach Gardens, FL (US); Bradley Workman, Snellville, GA (US); Jerry V. Foster, Valdosta, GA (US)

(73) Assignee: Wiles Technologies LLC, Palm Beach Gardens, FL (US)

( * ) Notice: Subject to any disclaimer, the term of this patent is extended or adjusted under 35 U.S.C. 154(b) by 25 days.

(21) Appl. No.: 16/026,031

(22) Filed: Jul. 2, 2018

(65) Prior Publication Data

US 2019/0009958 A1 Jan. 10, 2019

Related U.S. Application Data

(60) Provisional application No. 62/528,527, filed on Jul. 4, 2017, provisional application No. 62/636,811, filed on Feb. 28, 2018.

(51) Int. Cl.
*B65D 63/16* (2006.01)
*B65D 63/10* (2006.01)

(52) U.S. Cl.
CPC .... *B65D 63/1072* (2013.01); *B65D 2563/103* (2013.01); *B65D 2563/108* (2013.01)

(58) Field of Classification Search
CPC ..... B65D 2563/108; B65D 63/1072; B65D 2563/103
See application file for complete search history.

(56) References Cited

U.S. PATENT DOCUMENTS

| | | | |
|---|---|---|---|
| D201,798 | S | 8/1965 | Miller |
| D205,940 | S | 10/1966 | Miller |
| 3,837,047 | A | 9/1974 | Bunnel |
| 2,908,233 | A | 9/1975 | Caveney |
| 3,965,538 | A | 6/1976 | Caveney |
| 4,272,870 | A | 6/1981 | McCormick |
| 4,287,644 | A | 9/1981 | Durand |
| 4,347,648 | A | 9/1982 | Dekkers |
| 4,473,524 | A | 9/1984 | Paradis |
| 4,688,302 | A | 8/1987 | Caveney |

(Continued)

OTHER PUBLICATIONS

Protolabs, Design Consideratins for Overmolding and Insert Molding, retrieved from the Internet on Oct. 2, 2018, and available at: https://www.protolabs.com/resources/white-papers/overmolding-and-insert-molding/ (no publication date available).

(Continued)

*Primary Examiner* — Jack W Lavinder
(74) *Attorney, Agent, or Firm* — Benjamin C. Wiles

(57) ABSTRACT

Embodiments of the present technology relate to tie apparatus, such as those commonly referred to as "zip ties" or "cable ties." Advantageously, the disclosed technology increases the friction between a tie and the cables or other objects clinched by the tie. This is done by, for example, providing a gripping material on the inside of the strap. The disclosed technology also includes a head for a tie apparatus that can receive and engage a strap with a grip. Embodiments of the present technology also provide configurations for the grip on the strap.

20 Claims, 18 Drawing Sheets

(56) References Cited

U.S. PATENT DOCUMENTS

| | | | | |
|---|---|---|---|---|
| 4,754,529 | A | 7/1988 | Paradis | |
| 4,788,751 | A | 12/1988 | Shely | |
| 4,897,899 | A | 2/1990 | Shely | |
| 4,951,362 | A | 8/1990 | Denemark | |
| 5,193,254 | A | 3/1993 | Geisinger | |
| 5,267,373 | A | 12/1993 | Chisek | |
| 5,295,285 | A | 3/1994 | Shely | |
| 5,317,787 | A | 6/1994 | Fortsch | |
| 5,601,261 | A | 2/1997 | Koike | |
| 5,628,348 | A | 5/1997 | Scott | |
| 5,630,252 | A | 5/1997 | Wells | |
| D380,375 | S | 7/1997 | Rohaly | |
| 5,669,111 | A | 9/1997 | Rohaly | |
| D389,051 | S | 1/1998 | Caveney | |
| 5,836,053 | A | 11/1998 | Davignon | |
| 6,079,657 | A | 6/2000 | Hwang | |
| 6,105,210 | A | 8/2000 | Benoit | |
| 6,138,327 | A | 10/2000 | Powell | |
| D444,054 | S | 6/2001 | Bernard | |
| 6,279,203 | B1 | 8/2001 | Hundley | |
| 6,430,783 | B1 | 8/2002 | Benoit | |
| 6,484,366 | B1 | 11/2002 | Deschenes | |
| 6,497,258 | B1 | 12/2002 | Flannery | |
| D471,435 | S | 3/2003 | Krisel | |
| D488,374 | S | 4/2004 | Hussaini | |
| D530,600 | S | 10/2006 | Krisel | |
| D614,941 | S | 5/2010 | Murphy | |
| D619,887 | S | 7/2010 | Colton | |
| 8,479,361 | B2 | 7/2013 | Every | |
| 8,510,918 | B2 | 8/2013 | Shilale | |
| D698,632 | S | 2/2014 | Wang | |
| D700,826 | S | 3/2014 | Qin | |
| D701,453 | S | 3/2014 | Wang | |
| 8,726,468 | B2 * | 5/2014 | Dyer | B65D 63/1063 24/16 PB |
| 8,739,387 | B1 | 6/2014 | Frishberg | |
| D728,351 | S | 5/2015 | Martinson | |
| D728,352 | S | 5/2015 | Martinson | |
| 9,021,665 | B2 | 5/2015 | Chen | |
| D732,945 | S | 6/2015 | Asai | |
| D749,409 | S | 2/2016 | Martinson | |
| D769,704 | S | 10/2016 | Nitta | |
| D776,516 | S | 1/2017 | Geiger | |
| D778,148 | S | 2/2017 | Iwahara | |
| D778,710 | S | 2/2017 | Nagayasu | |
| D779,314 | S | 2/2017 | Adams | |
| D779,924 | S | 2/2017 | Nagayasu | |
| D781,136 | S | 3/2017 | Nagayasu | |
| D799,125 | S | 10/2017 | Bolinger | |
| D800,539 | S | 10/2017 | Geiger | |
| 9,958,089 | B2 | 5/2018 | Geiger | |
| D835,495 | S | 12/2018 | Votel | |
| D836,429 | S | 12/2018 | Kozminske | |
| D840,788 | S | 2/2019 | Geiger | |
| D844,416 | S | 4/2019 | Dyer | |
| 2005/0115029 | A1 | 6/2005 | Magno | |
| 2006/0162130 | A1 * | 7/2006 | Cook | B65D 63/1072 24/16 PB |
| 2009/0172922 | A1 | 7/2009 | Laporte | |
| 2010/0146742 | A1 | 6/2010 | Every | |
| 2012/0272485 | A1 | 11/2012 | Liang | |
| 2013/0067695 | A1 | 3/2013 | Giotto | |
| 2014/0208547 | A1 | 7/2014 | Hollins | |
| 2016/0214776 | A1 | 7/2016 | King | |
| 2016/0355243 | A1 | 12/2016 | Hynes | |
| 2017/0327194 | A1 | 11/2017 | Zimmerman | |

OTHER PUBLICATIONS

International Searching Authority, International Search Report and Written Opinion for related PCT Patent Application PCT/US18/40655, dated Sep. 28, 2018.

* cited by examiner

REDUCED SLIP TIE STRAP

CROSS-REFERENCE TO RELATED APPLICATIONS

This application claims benefit under 35 U.S.C. § 119(e) of U.S. Provisional Patent Application No. 62/528,527, filed Jul. 4, 2017, and entitled "Reduced Slip Tie Strap," and also U.S. Provisional Patent Application No. 62/636,811, filed Feb. 28, 2018, and entitled "Reduced Slip Tie Strap," both of which are incorporated herein by reference as if set forth herein in their entireties.

FIELD OF THE INVENTION

Embodiments of the present technology relate generally to strap systems, and, more particularly, to tie apparatus such as cable ties and/or zip ties.

BACKGROUND

Several types of tie apparatus are known. One type, sometimes referred to a "zip tie" or "cable tie," has a head and a strap extending from the head. The tip of the strap can loop around and be pulled through the head, and the body of the strap can thereby be pulled through the head and locked in place to create a working tie. This type of tie is sometimes used to secure cables or other bundled objects.

This type of tie has disadvantages, however. For example, while it can confine cables or other bundled objects within the strap, the strap can slide on the cables or other objects, thereby allowing either the tie or the objects to move. In some situations, this can enable the objects to slip out of the tie, thereby limiting usefulness of the tie.

BRIEF SUMMARY

Embodiments of the present technology increase the friction between a tie and the cables or other objects clinched by the tie. This can be done, for example, by providing a grip on the inside of the strap. The grip can have a higher coefficient of friction than materials commonly used on the inside of tie straps, thereby providing increased frictional force when compared to common straps.

The placement of a grip on the strap, however, can prevent the strap from being usable with common tie heads, and thus embodiments of the present technology also provide a tie head that can receive and engage a strap with a grip on it. Embodiments of the present technology also provide configurations for the grip. Since the grip could, in some cases, be difficult to pass through the head or to position on the gripped objects, embodiments of the present technology also address head designs and/or strap configurations that alleviate these potential difficulties.

Additionally, embodiments of the present technology relate to methods of making and using a tie strap as described above and herein.

Embodiments of the present technology can therefore include a tie apparatus comprising a strap, the strap comprising a top side and a bottom side. The top side can have one or more ratchet teeth and the bottom side can have a grip, and the grip can be configured to increase friction between the strap and one or more objects engaged by the tie apparatus. The tie apparatus can also have a head, and the head can have one or more pawl teeth to engage one or more of the ratchet teeth to secure the strap with the head. In some embodiments, the strap can further comprise a cavity, and at least a portion of the grip can be disposed in the cavity. In some embodiments, the head can further comprise a channel to receive the grip. In some embodiments, the head can further comprise lower shoulders on either side of the channel. Moreover, in some embodiments, the strap can slide through the head in one direction, but the engagement of the pawl teeth and the ratchet teeth can substantially prevent the strap from sliding through the head in the opposite direction. In some embodiments, the grip can move through the channel as the strap slides through the head.

Embodiments of the present technology can also include a tie apparatus with a strap, and the strap can comprise a top side and a bottom side. The bottom side can have a grip, and the grip can be configured to increase friction between the strap and one or more objects engaged by the tie apparatus. The tie apparatus can also have a head, and the head can have a channel to receive the grip. In some embodiments, the head can further comprise lower shoulders on each side of the channel. In some embodiments, the strap can further comprise lower landings beside the grip. In some embodiments, the strap can slide through the head in one direction but can be prevented from sliding through the head in the opposite direction. Moreover, in some embodiments, the lower landings can slide on the lower shoulders as the strap slides through the head. In some embodiments, the grip can move through the channel as the strap slides through the head. In some embodiments, the grip can extend most of the length of the strap. Additionally, in some embodiments, the strap further comprises a cavity, and at least a portion of the grip can be disposed in the cavity.

Embodiments of the present technology can also include a tie apparatus with a strap extending from a head. The strap can have a grip on a first side and ratchet teeth on a second side. The tie apparatus can also have a head to receive and secure the strap. In some embodiments, when the strap is received and secured by the head, the strap can form a loop with the grip facing the inside of the loop. In some embodiments, the perimeter of the loop can be adjustable. In some embodiments, the head can have pawl teeth to engage the ratchet teeth when the head receives and secures the strap. Moreover, in some embodiments, the head can include a slot to receive the strap and a channel to receive the grip when the head receives and secures the strap. In some embodiments, the grip can have a higher coefficient of friction than the rest of the strap. In some embodiments, the strap further comprises a cavity, and at least a portion of the grip can be disposed in the cavity and at least a portion of the grip can be protruding from the cavity.

Embodiments of the present technology can also include a tie apparatus comprising a strap, the strap comprising a top side and a bottom side. The top side can have one or more ratchet teeth and the bottom side can have a grip. The grip can be configured to increase friction between the strap and one or more objects engaged by the tie apparatus. The tie apparatus can also have a head, and the head can have one or more pawl teeth to engage one or more of the ratchet teeth to secure the strap with the head. In some embodiments, the head can further comprise a channel to receive the grip. In some embodiments, the head can further comprise lower shoulders on either side of the channel. In some embodiments, the strap can further comprise lower landings beside the grip. In some embodiments, the strap can slide through the head in one direction, but the engagement of the pawl teeth and the ratchet teeth can substantially prevent the strap from sliding through the head in the opposite direction. Moreover, in some embodiments, the lower landings can slide on the lower shoulders when the strap slides through the head. In some embodiments, the grip can move through the channel as the strap slides through the head. In some embodiments, the grip can extend most of the length of the strap. In some embodiments, the pawl teeth can be part of a ratchet mechanism that can also include a biasing member. In some embodiments, the head can further comprise upper shoulders on either side of the ratchet mechanism. In some embodiments, the channel can extend through the head from the top side of the head to the bottom side of the head. In some embodiments, the grip can be substantially centered on the width of the strap. In some embodiments, the strap can further comprising a cavity, and at least a portion of the grip can be disposed in the cavity. In some embodiments the strap can further comprise two or more holes with larger dimensions at a top-side-end than at a bottom-side-end. In some embodiments, the grip further comprises tabs that substantially fill the holes.

Embodiments of the present technology can also include a tie apparatus with a strap, and the strap can comprise a top side and a bottom side. The bottom side can have a grip, and the grip can be configured to increase friction between the strap and one or more objects engaged by the tie apparatus. The tie apparatus can also have a head, and the head can have a channel to receive the grip. In some embodiments, the head can further comprise lower shoulders on either side of the channel. In some embodiments, the strap can further comprise lower landings beside the grip. In some embodiments, the strap can slide through the head in one direction but can be prevented from sliding through the head in the opposite direction. Moreover, in some embodiments, the lower landings can slide on the lower shoulders when the strap slides through the head. In some embodiments, the grip can move through the channel as the strap slides through the head. In some embodiments, the grip can extend most of the length of the strap. In some embodiments, the channel can extend through the head from the top side of the head to the bottom side of the head. In some embodiments, the grip can be substantially centered on the width of the strap. In some embodiments, the strap can further comprise a cavity, and at least a portion of the grip can be disposed in the cavity. In some embodiments, the strap can further comprise two or more holes with larger dimensions at a top-side-end than at a bottom-side-end. In some embodiments, the grip can further comprise tabs that substantially fill the holes.

Embodiments of the present technology can also include a head for a tie apparatus. The tie apparatus can have a strap connected to the head, and the strap can include a grip. The head can comprise two lower shoulders proximate the end of the head connected to the strap, and the lower shoulders can have a channel therebetween. In some embodiments, the head can further comprise two upper shoulders proximate the end of the head not connected to the strap, and the upper shoulders can have a ratchet mechanism therebetween, and the ratchet mechanism can be configured to engage the strap. In some embodiments, the head can further comprise a ratchet mechanism having two upper shoulders, and the ratchet mechanism can be configured to engage the strap. In some embodiments, the channel can extend through the head from the top side of the head to the bottom side of the head. In some embodiments, the head can further comprise a slot to receive the strap, and the head can be configured so that the grip moves through the channel as the strap slides through the slot.

Embodiments of the present technology can also include a tie apparatus with a strap extending from a head. The strap can have a grip on a first side and ratchet teeth on a second side. The tie apparatus can also have a head to receive and secure the strap. In some embodiments, when the strap is received and secured by the head, the strap can form a loop with the grip facing the inside of the loop. In some embodiments, the perimeter of the loop can be adjustable.

Embodiments of the present technology can also include a tie apparatus comprising a strap having a gripping material on a first side and ratchet teeth on a second side. The tie apparatus can have a head to receive and secure the strap, and the head can have pawl teeth to engage the ratchet teeth when the head receives and secures the strap. In some embodiments, the head can comprise a channel to receive the grip when the head receives and secures the strap. In some embodiments, the strap can further comprise a cavity, and at least a portion of the gripping material can be disposed in the cavity. In some embodiments, the strap can further comprise two or more holes with larger dimensions at a top-side-end than at a bottom-side-end. In some embodiments, the gripping material can form a grip with tabs that substantially fill the holes.

Embodiments of the present technology can also include a tie apparatus comprising a head and a strap having a first side and a second side. The first side can at least partially form an inside of a loop when the strap is engaged with the head, and the first side can have a grip. In some embodiments, the grip can have a smooth surface. In some embodiments, the grip can have a textured surface. In some embodiments, the grip can be disposed on the strap. In some embodiments, the strap can have a cavity and the grip can be disposed at least partially within the cavity. In some embodiments, the cavity can extend into the strap from the first side of the strap. In some embodiments, the cavity can have wings that can be wider than an entrance to the cavity. Moreover, in some embodiments, the head can have a channel to receive the grip when the strap is engaged with the head. In some embodiments, the grip can be substantially centered on the width of the strap.

Embodiments of the present technology can also include a tie apparatus comprising a first side having ratchet teeth and a second side having a grip. In some embodiments, the grip can have a smooth surface. In some embodiments, the grip can have a textured surface. In some embodiments, the grip can be disposed on the strap. In some embodiments, the strap can have a cavity and the grip can be disposed at least partially within the cavity.

Embodiments of the present technology can also include a method for gripping objects with a tie apparatus having a tie strap with a grip. The method can comprise positioning the tie apparatus so that a side of the tie strap with the grip faces the objects, inserting a tip of the tie strap into a head of the tie apparatus, and pulling the tie strap at least partially through the head. In some embodiments, the method can further comprise pulling the strap at least partially through the head such that the grip exerts a desired gripping force on at least a portion of the objects. In some embodiments, the method can further comprise setting the strap, and in some embodiments, setting the strap can include pushing the strap.

Embodiments of the present technology can also include a method of making a tie apparatus. The method can comprise molding, in a mold, a portion of the tie apparatus including a head and a strap, and also molding a grip onto the strap. In some embodiments, the method can further comprise changing a profile of the mold after molding the head and the strap and before molding the grip onto the strap. In some embodiments, changing a profile of the mold can comprise removing or replacing a portion that does not provide a molding area for the grip and adding a new portion that does provide a molding area for the grip. In some embodiments, after molding the head and the strap, the head and the strap can be moved to a second mold, and after moving the grip can be molded onto the strap. In some embodiments molding the head and strap can comprise molding with a first material and molding the grip can comprise molding with a second material different than the first material.

The foregoing summarizes only a few aspects of the present technology and is not intended to be reflective of the full scope of the present technology. Additional features and advantages of the present technology are set forth in the following detailed description and drawings, may be apparent from the detailed description and drawings, or may be learned by practicing the present technology. Moreover, both the foregoing summary and following detailed description are exemplary and explanatory and are intended to provide further explanation of the presently disclosed technology as claimed.

DETAILED DESCRIPTION

Figure 1A:
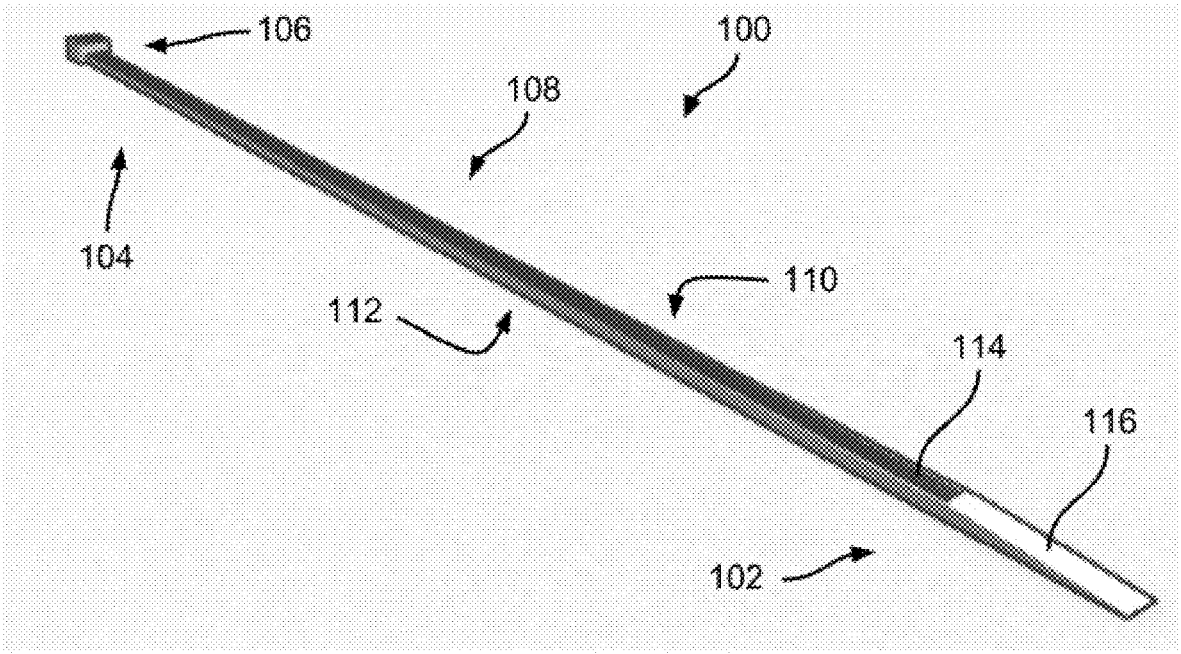
FIG. 1A depicts a top-front perspective view of a tie apparatus of the present technology.
Figure 1B:
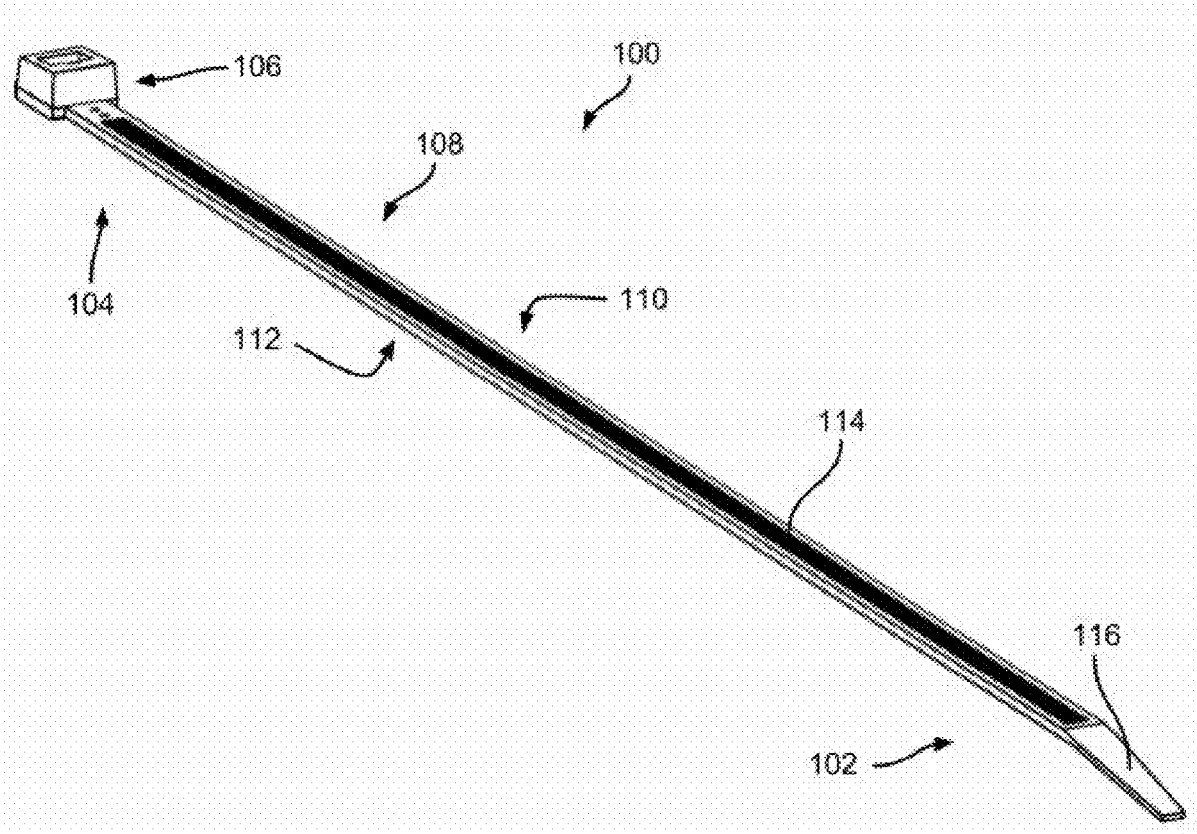
FIG. 1B depicts a top-front perspective view of a tie apparatus of the present technology.
Figure 2A:
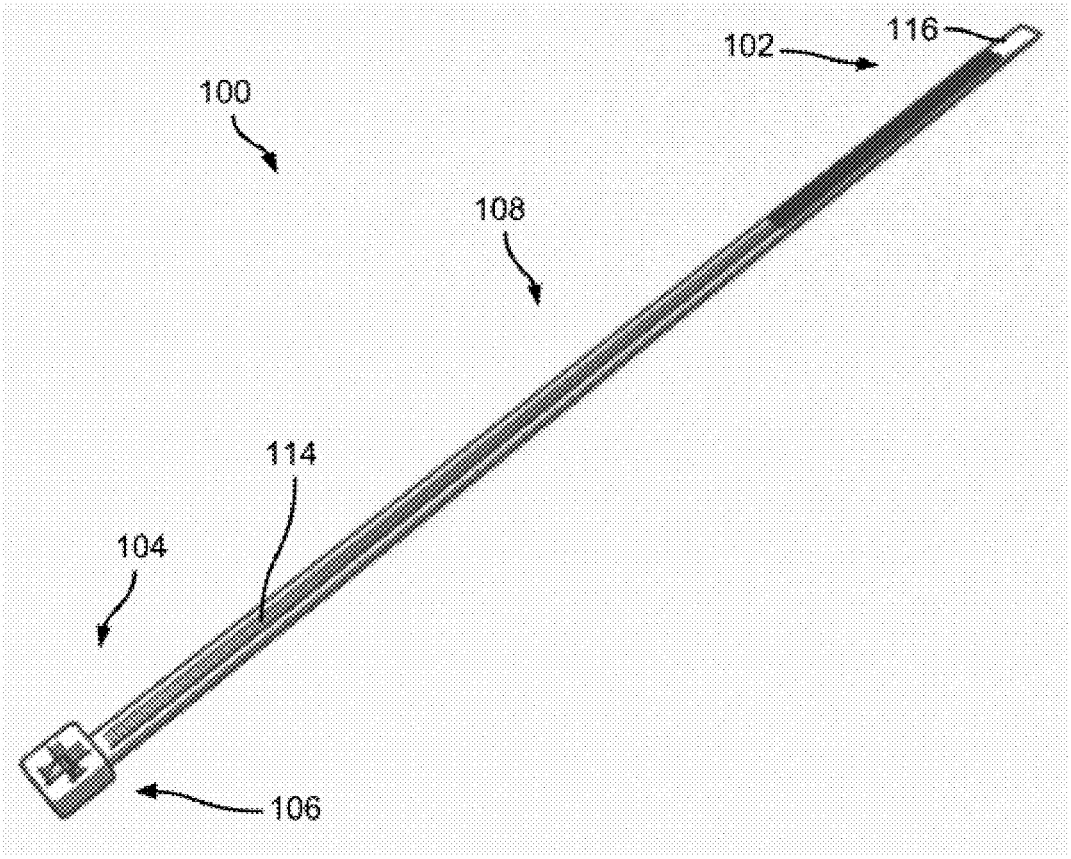
FIG. 2A depicts a top-rear perspective view of a tie apparatus of the present technology.
Figure 2B:
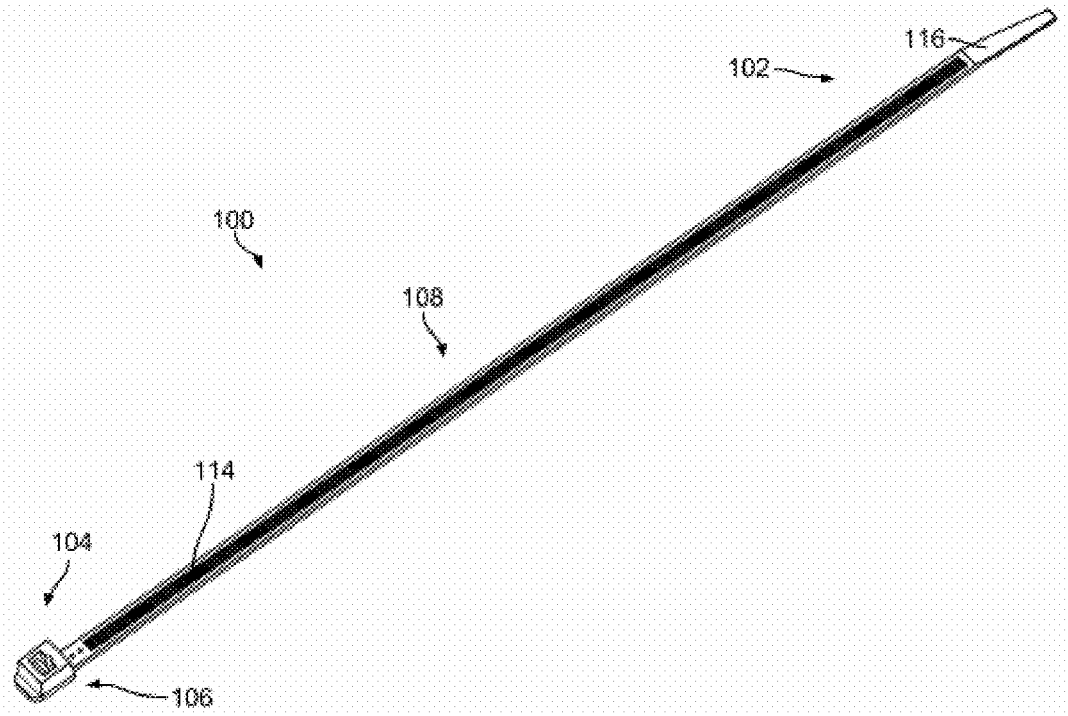
FIG. 2B depicts a top-rear perspective view of a tie apparatus of the present technology.
Figure 3A:
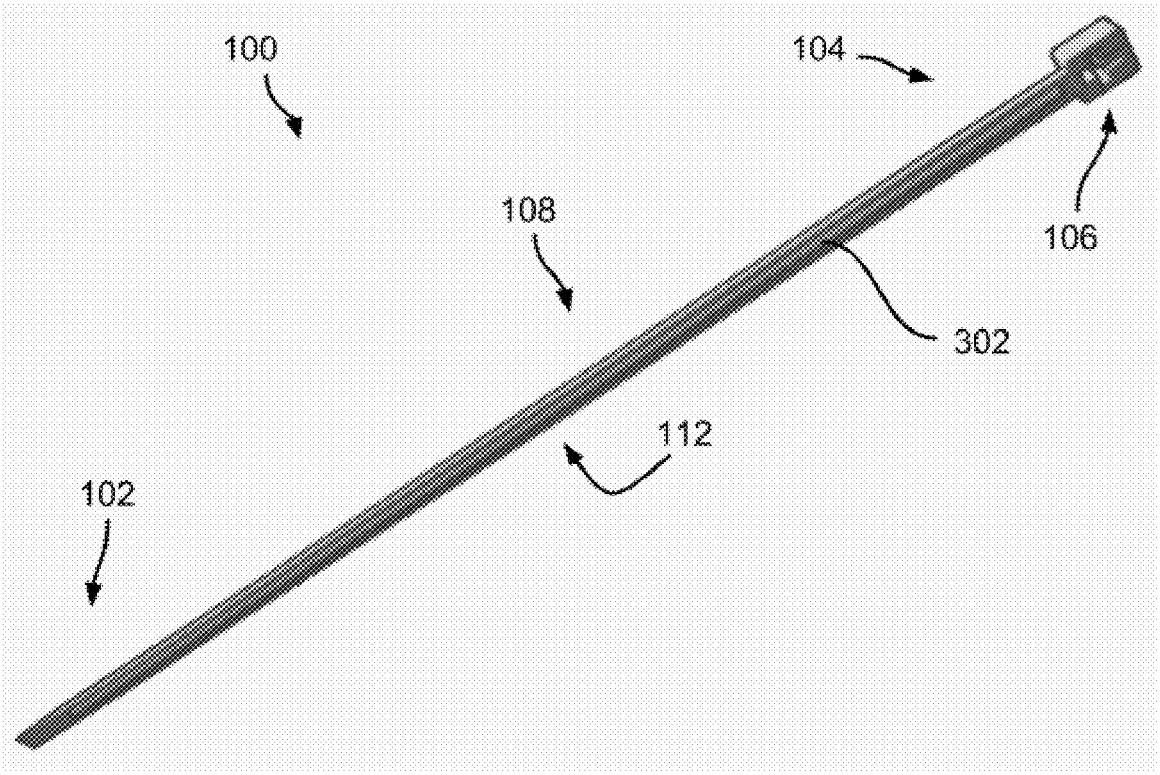
FIG. 3A depicts a bottom perspective view of a tie apparatus of the present technology.
Figure 3B:
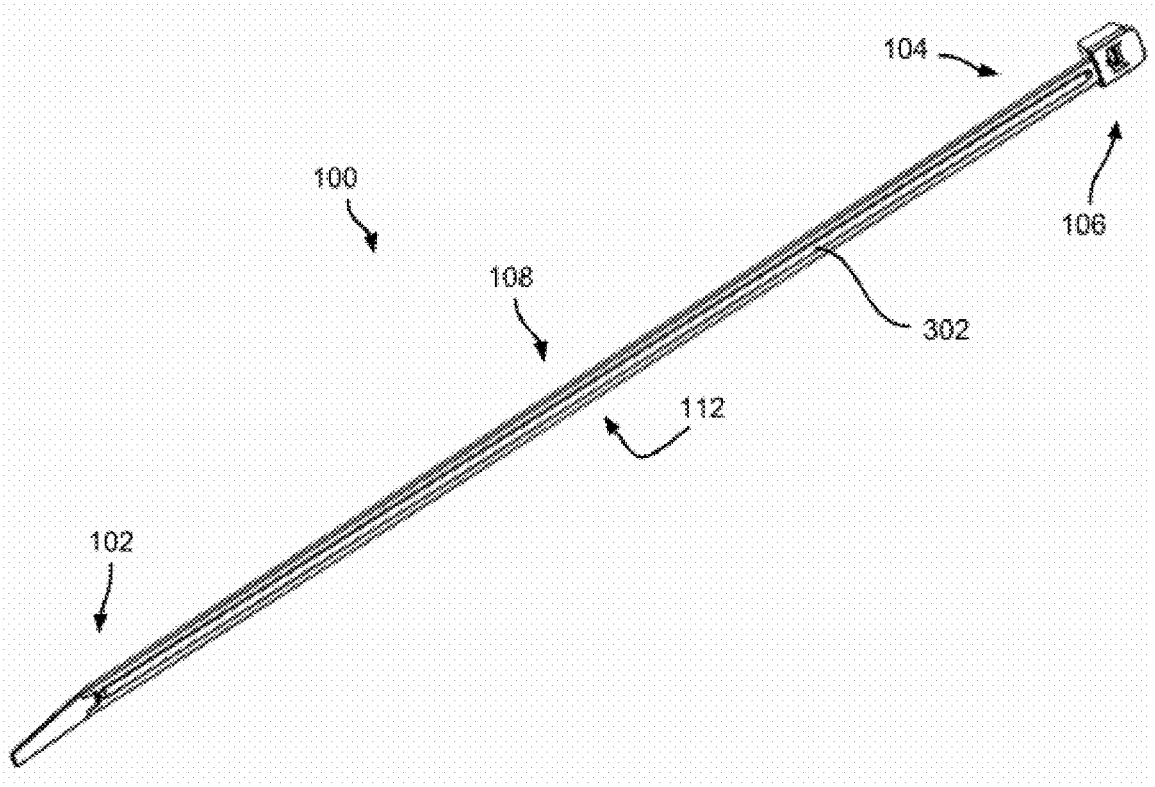
FIG. 3B depicts a bottom perspective view of a tie apparatus of the present technology.

The present technology related to reduced slip tie apparatus will now be described. Although preferred embodiments of the technology are explained in detail, it is to be understood that other embodiments are contemplated. Accordingly, it is not intended that the invention is limited in its scope to the details of construction and arrangement of components set forth in the following description or illustrated in the drawings. The invention is capable of other embodiments and of being practiced or carried out in various ways. Also, in describing the various embodiments, specific terminology will be resorted to for the sake of clarity.

It should also be noted that, as used in the specification and the appended claims, the singular forms "a," "an" and "the" include plural references unless the context clearly dictates otherwise. References to a composition containing "a" constituent is intended to include other constituents in addition to the one named.

Also, in describing embodiments of the technology, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/or to "about" or "approximately" or "substantially" another particular value. When such a range is expressed, other exemplary embodiments include from the one particular value and/or to the other particular value.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

It is also to be understood that the mention of one or more method steps does not preclude the presence of additional method steps or intervening method steps between those steps expressly identified. Moreover, although the term "step" may be used herein to connote different aspects of methods employed, the term should not be interpreted as implying any particular order among or between various steps herein disclosed unless and except when the order of individual steps is explicitly required.

The components described hereinafter as making up various elements of the technology are intended to be illustrative and not restrictive. Many suitable components that would perform the same or similar functions as the components described herein are intended to be embraced within the scope of the invention. Such other components not described herein can include, but are not limited to, for example, similar components that are developed after development of the presently disclosed subject matter.

To facilitate an understanding of the principles and features of the technology, various illustrative embodiments are explained below. In particular, the presently disclosed subject matter is described in the context of tie apparatus, like those commonly referred to as "zip ties" or "cable ties." The present technology, however, is not so limited, and can be applicable in other contexts.

As shown, for example, in FIGS. 1A-2B, embodiments of the present technology include a tie apparatus 100, like a zip tie or cable tie. The tie apparatus 100 can have a first end 102 and a second end 104. The second end 104 can include a head 106, and there can be a strap 108 extending from the head 106 to the first end 102. The first end 102 of the tie apparatus 100 can be at the opposite end of the strap 108 from the head 106, and can include a tip 116 of the strap 108. The tie apparatus 100 can also have a top side 110 and a bottom side 112.

Figure 6A:
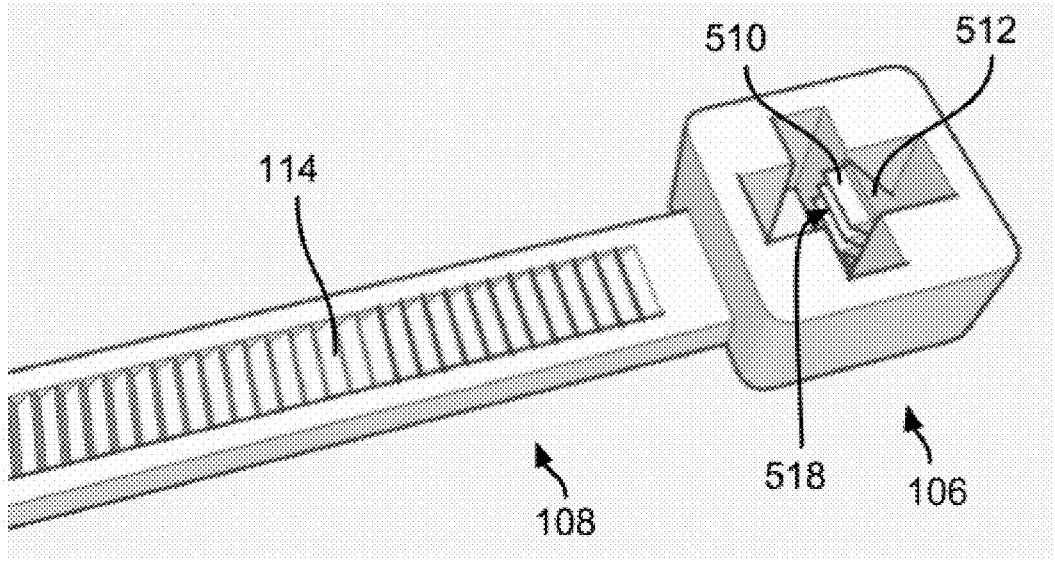
FIG. 6A depicts a top perspective view of a head and strap of a tie apparatus of the present technology.
Figure 6B:
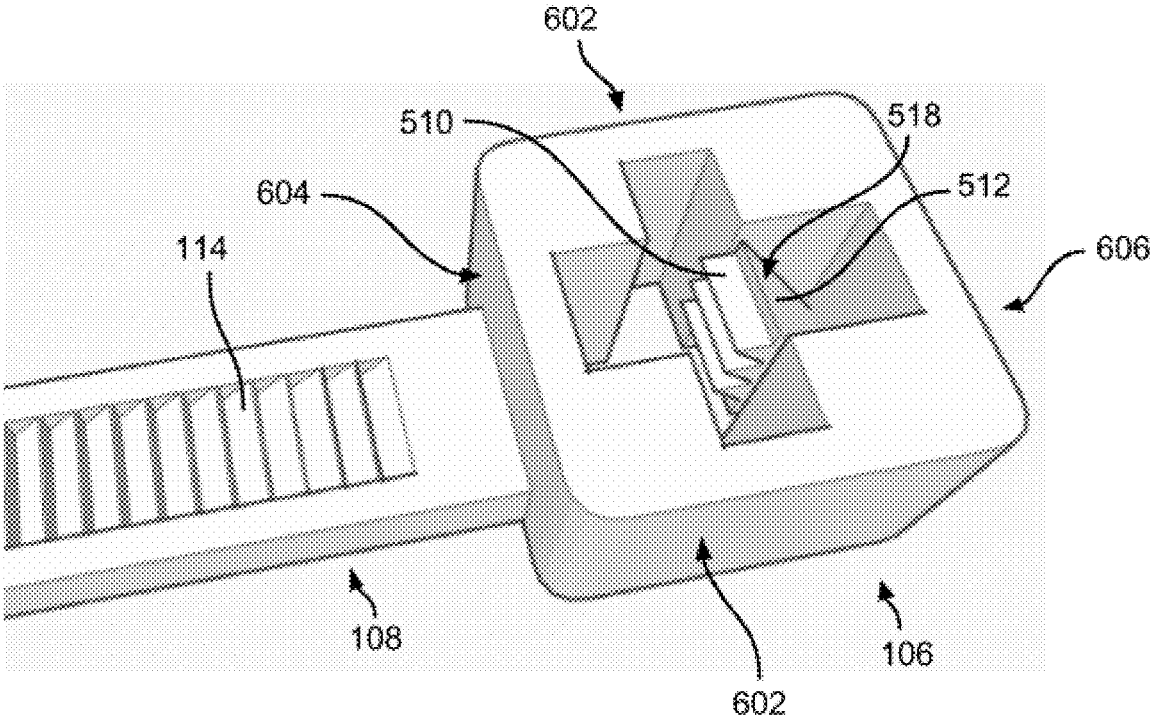
FIG. 6B depicts a top perspective view of a head and strap of a tie apparatus of the present technology.
Figure 6C:
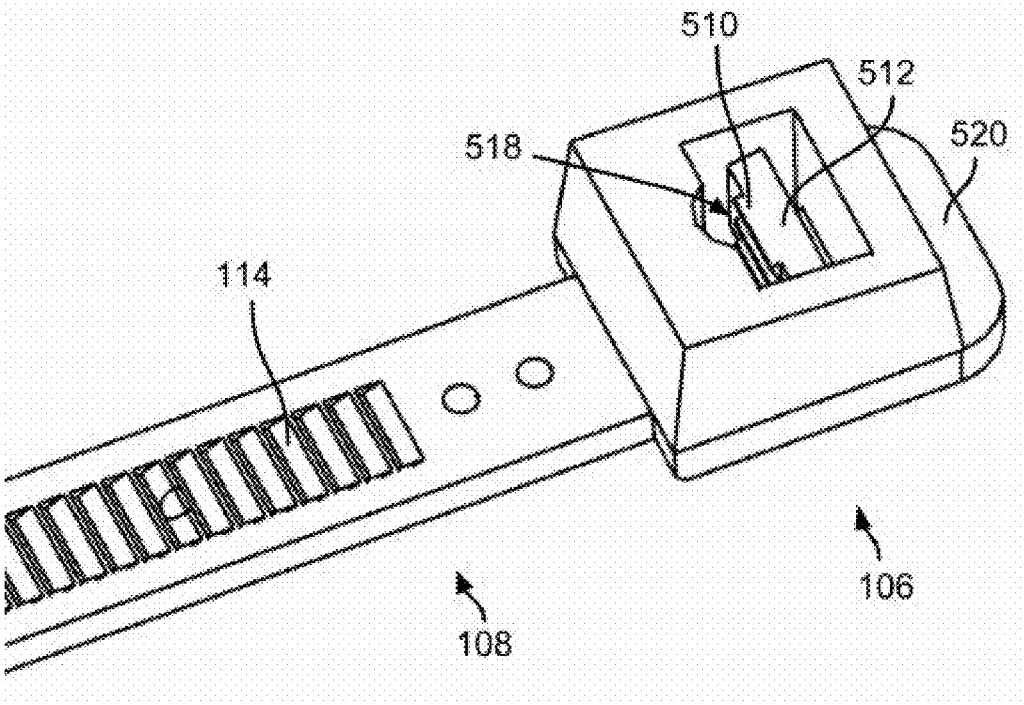
FIG. 6C depicts a top perspective view of a head and strap of a tie apparatus of the present technology.
Figure 6D:
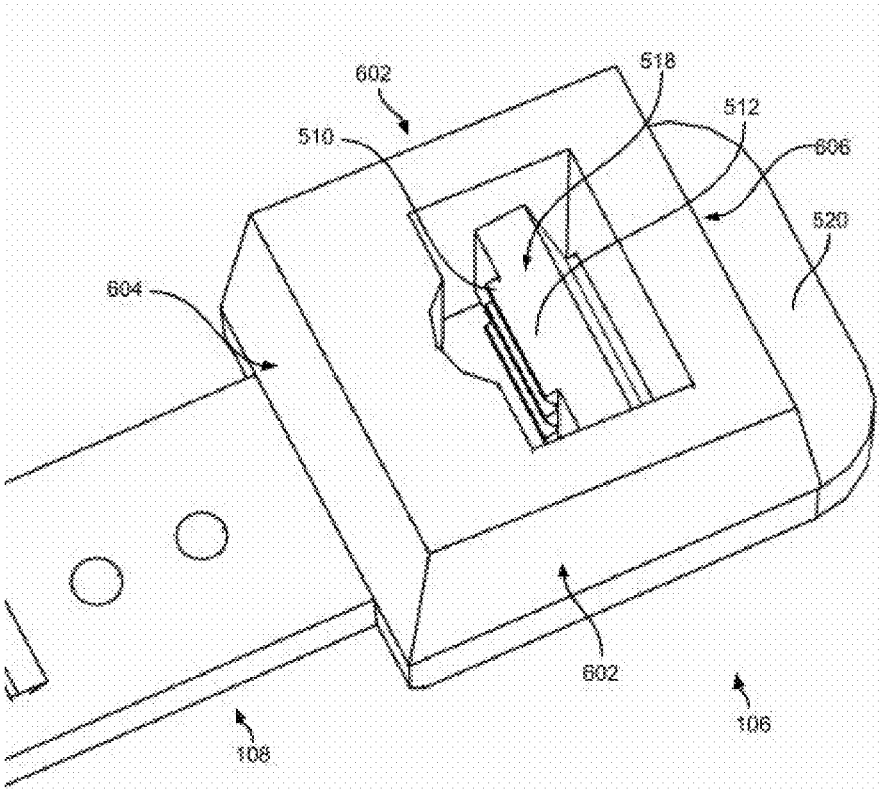
FIG. 6D depicts a top perspective view of a head and strap of a tie apparatus of the present technology.

One of the sides of the strap 108, for example the top side 110, can include a plurality of ratchet teeth 114. The ratchet teeth 114 can engage pawl teeth 510 (see FIGS. 5B, 5E, 6A-6D) of the head 106 to lock the tie, as described below. As shown most clearly in FIGS. 6B, 6E and 19, the ratchet teeth 114 can be angled on one side and substantially vertical (as oriented in FIGS. 6B, 6E and 19) on the other. As described in more detail below, in conjunction with the pawl teeth 510, this enables the strap 108 to slide through the head 106 in one direction; however, the engagement of the pawl teeth 510 and the ratchet teeth 114 substantially prevents the strap 108 from sliding through the head 106 in the opposite direction, thereby locking the strap 108 in the head 106 and substantially preventing it from coming loose.

As shown in FIGS. 3A-4B, one of the sides of the strap 108, for example the bottom side 112, can include a grip 302. When the tie apparatus 100 is in use, the grip 302 can engage objects clinched by the tie apparatus 100. The grip 302 can have a higher coefficient of friction than the inside surface of common tie straps, thereby increasing the frictional force between the strap 108 and the clinched objects when compared to common straps. This can be because the grip 302 can be made from a different material than common tie straps. In many applications, this design can prevent, or substantially prevent, the tie apparatus 100 and the clinched objects from slipping with respect to each other during use.

As shown in FIGS. 5A-5E the head 106 can include a slot 502 for receiving all or part of the strap 108, and can be the area where the the strap 108 passes through the head 106. In embodiments including upper shoulders 504 and lower shoulders 506 of the head 106, the slot 502 can be disposed between the shoulders 504, 506. In some embodiments, the lower shoulders 506 can define a channel 508 between them, and as described below, the channel 508 can be suitable for receiving the grip 302 when the head 106 receives and engages the strap 108.

In use, the tip 116 of the strap 108 can be inserted through the slot 502 from the bottom side 112 of the head 106. The tip 116 can then be pulled through the slot 502. As the tip 116 and then some or substantially all of the rest of the strap 108 is pulled through, the grip 302 moves through the channel 508. The channel 508 therefore accommodates the grip 302, enabling a strap 108 with a grip 302 to be pulled through the head 106. At the same time, as the strap 108 is pulled through the head 106, one or more of the ratchet teeth 114 engage one or more of the pawl teeth 510 (see FIGS. 5B, 5E, 6A-6C). Similar to the ratchet teeth 114, the pawl teeth 510 can can be angled on one side and substantially horizontal (as oriented in FIGS. 5A and 6C) on the other. This enables the ratchet teeth 114 and the pawl teeth 510 to engage such that the strap 108 slides through the head 106 as the strap 108 is pulled from the bottom side 112 to the top side 110, but the engagement of the pawl teeth 510 and the ratchet teeth 114 substantially prevents the strap 108 from sliding through the head 106 in the opposite direction, i.e., from the top side 110 to the bottom side 112.

To assist in enabling the ratchet teeth 114 to move past the pawl teeth 510, the pawl teeth 510 can be disposed on a lever 512 or other biasing member, forming a ratchet mechanism 518. As shown, the ratchet mechanism 518 can extend from the upper side of head 106, opposite the lower side where the strap connects to the head 106. When the ratchet teeth move past the pawl teeth 510, as the as the strap 108 is pulled from the bottom side 112 to the top side 110 of the head 106, the ratchet teeth 114 can put pressure on the pawl teeth 510, causing the lever 512 to flex with respect to the head 106 and facilitating movement of the ratchet teeth 114 past the pawl teeth 510. When the ratchet teeth 114 move past the pawl teeth 510, the pressure on the lever 512 can be substantially relieved and the lever 512 can spring back into place, enabling the engagement of the ratchet teeth 114 and the pawl teeth 510 and substantially preventing the strap 108 from moving through the head 106 from the top side 110 to the bottom side 112. If the strap 108 is pulled further through the head 106, the process continues.

Thus, to engage one or more objects with the tie apparatus 100, a user can position the tie apparatus 100 so that the grip 302 faces the objects to be clinched. The user can then wrap or loop the strap 108 around the objects and into the slot 502 of the head 106. As the strap 108 is pulled through the head 106, an enclosure of a desired perimeter is formed by the strap 108. Moreover, the interaction between the pawl teeth 510 and the ratchet teeth 114 can prevent the strap 108 from loosening. Additionally, the grip 302, combined with the pressure placed on the objects by the strap 108 and at least partially through the grip 302, can prevent or substantially reduce movement of the objects with respect to the tie apparatus 100.

Figure 9:
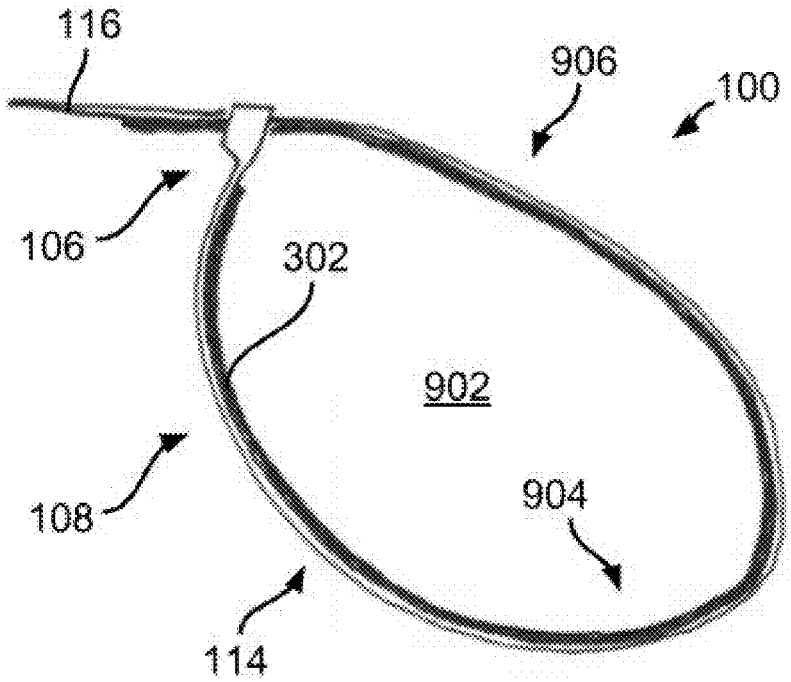
FIG. 9 depicts a side view of a tie apparatus of the present technology.
Figure 10:
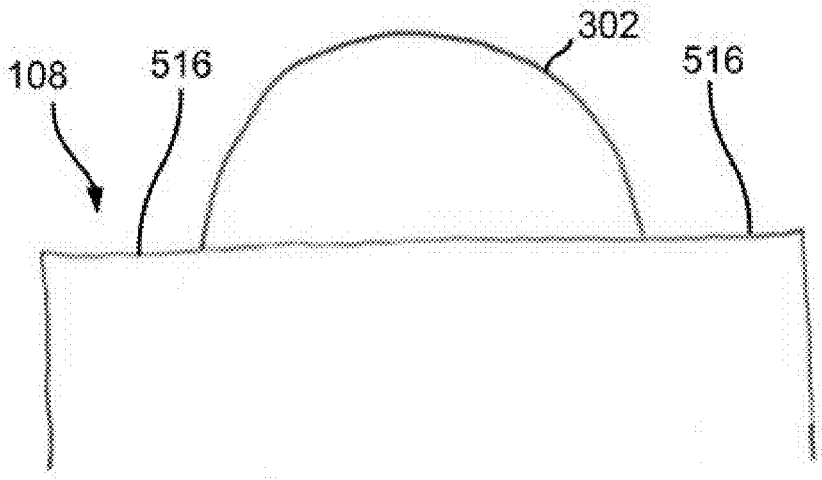
FIG. 10 depicts a cross section of a portion of a strap, including a substantially semi-circular grip, of a tie apparatus of the present technology.

FIG. 9 shows that the strap 108 can be pulled through the head 106 to form a tie apparatus 100 with a loop 902 of a desired, adjustable size. The grip 302 can be on the inside 904 of the loop 902, and the ratchet teeth 114 can be on the outside 906 of the loop 902. As explained above, the strap 108 can be pulled through the head 106 to form a loop 902 of a desired perimeter, and thus can put pressure on the objects clinched by the tie apparatus 100. In conjunction with the grip 302, this can prevent, or substantially prevent, the tie apparatus 100 and the object(s) clinched within the loop 902 from slipping with respect to one another during use.

As explained above, the head 106 can include upper shoulders 504 and lower shoulders 506, with a slot 502 therebetween. As shown in FIGS. 5A-6E, in some embodiments the upper shoulders 504 can be fixed to the sidewalls 602, 604, 606 of the head, and in some embodiments the upper shoulders 504 can be part of the ratchet mechanism 518. In addition, the slot 502 can be sized and shaped to accommodate the strap 108 such that the strap 108 is securely maintained in the slot 502 and does not move in an unintended or undesirable way. Thus, the height and width of the strap 108, and the height and width of the slot 502, can be similarly dimensioned, enabling the strap 108 to move through the head 106, but also providing minimal room for additional movement. More particularly, in some embodiments, the shoulders 504, 506, and the other sides of the slot 502, can maintain the strap 108 such that the ratchet teeth 114 remain engaged to the pawl teeth 510 and do not separate from the pawl teeth 510 to unintentionally enable the strap 108 to move backwards through the head 106, even when forces are being applied to the strap 108. Moreover, in some embodiments, the similar dimensions of the strap 108 and the slot 502 can prevent the grip 302 from contacting the lower shoulders 506 as the strap 108 is pulled through the head 106 by preventing the strap 108 from moving side-to-side in the slot 502. This can facilitate use as it enables the strap 108 to be pulled through the head 106 easily, without contact between the grip 302 and other parts of the head 106, such as lower shoulders 506, as such contact could make it difficult to pull the strap 108 through the head 106. In some embodiments, to reduce friction if contact is made between the lower shoulders and the grip 302, the bottom side 112 corners of the lower shoulders 506, leading into the channel 508, can be rounded.

As shown in FIGS. 5A-5E, to interface with the upper shoulders 504 the strap 108 can have upper landings 514, and to interface with the lower shoulders 506 the strap 108 can have lower landings 516. Thus, in a locked state when the strap 108 is secured with the head 106, the landings 514, 516 can abut, or be in close proximity to, the respective shoulders 504, 506. In some embodiments, the upper landings 514 can be on opposing sides of ratchet teeth 144 and lower landings 516 can be on opposing sides of grip 302. In some embodiments, the landings 514, 516 can be smooth surfaces that slide against the shoulders 504, 506 as the strap 108 is pulled through the head 106. This configuration can facilitate movement of the strap 108 through the head 106, as the landings 514, 516 can slide on the shoulders 504, 506.

Figure 6E:
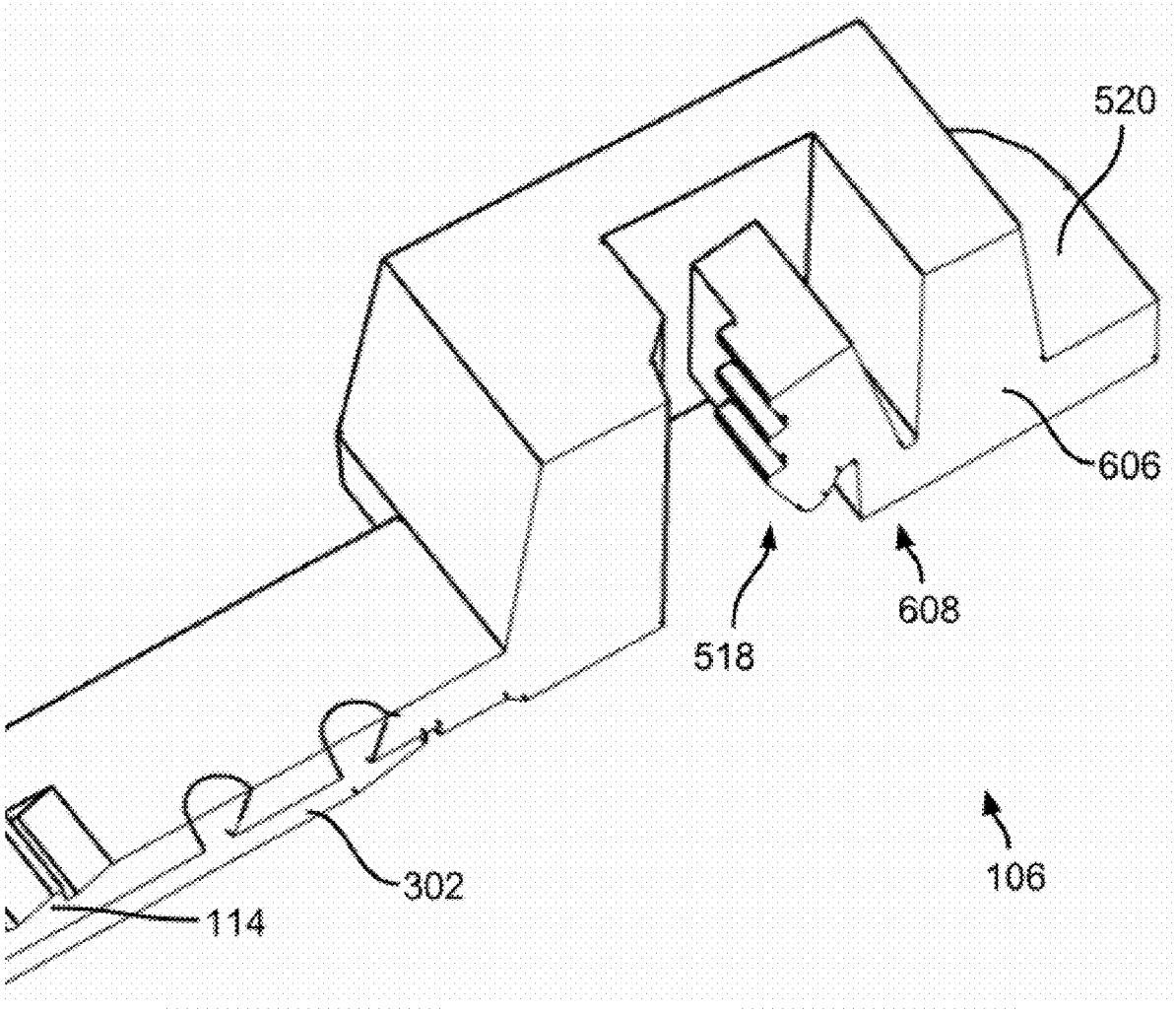
FIG. 6E depicts a cross sectional, top perspective view of a head and strap of a tie apparatus of the present technology.
Figure 7:
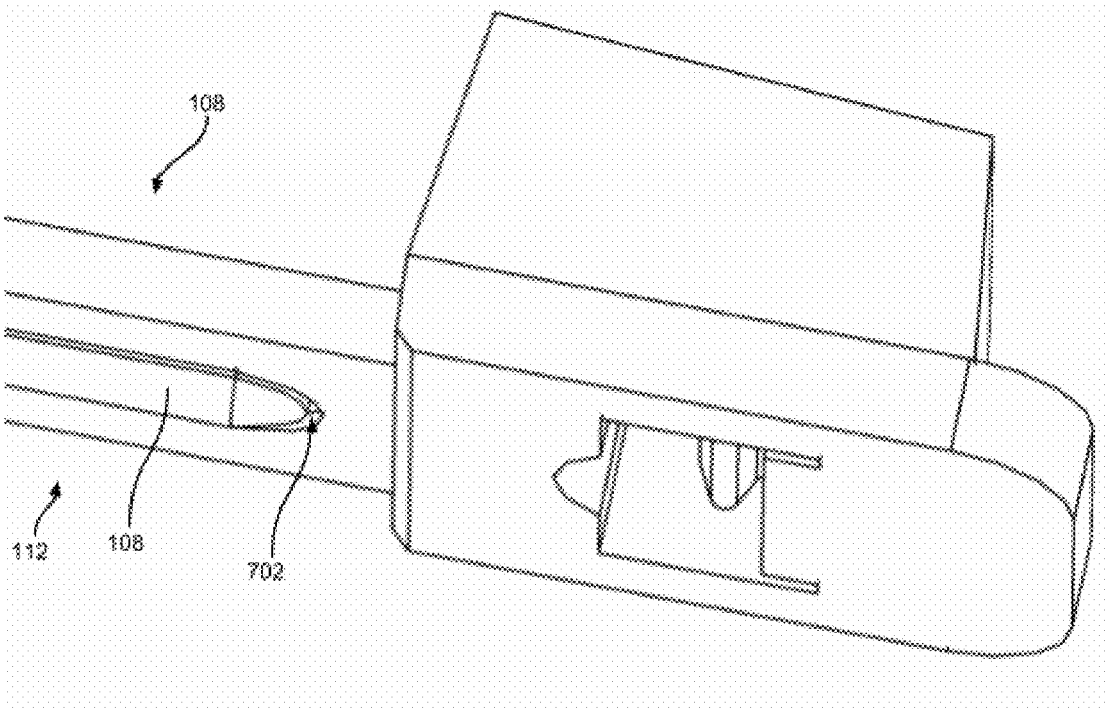
FIG. 7 depicts a bottom perspective view of a head and strap of a tie apparatus of the present technology.
Figure 8:
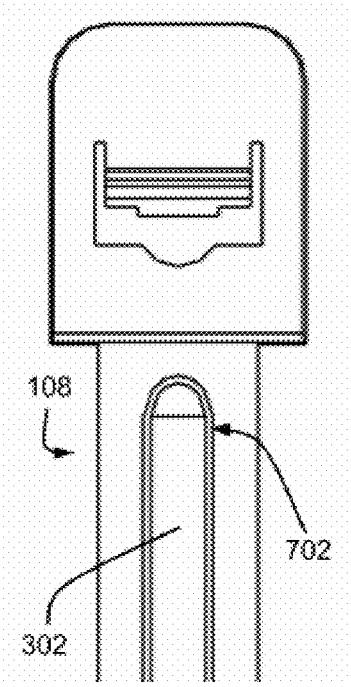
FIG. 8 depicts a bottom view of a head and strap of a tie apparatus of the present technology.

In addition, the forces exerted on the head 106 when a user or object exerts a force (such as pulling) on the strap 108 can be transferred from the strap 108 to the head 106 through the landings 514, 516. This can be advantageous because it can reduce or minimize the forces exerted on the ratchet teeth 114 and pawl teeth 510, which provides several advantages, including reducing the chance that the teeth 114, 510 will break and the strap 108 will come loose. FIGS. 5A, 5B, 6A, and 6B show that the upper shoulders 504 can be integral with the side walls 602 and upper wall 606 of the head 106, which can add strength to the design and prevent undesirable wall 602, 604, 606 deformations when forces are applied. FIGS. 5C-5E and 6C-6E show that, in some embodiments, the entire ratchet mechanism 518 can be wider than pawl teeth 510, and can also include upper shoulders 504 on both sides of the pawl teeth 510. In some embodiments, upper shoulders 504 can absorb much of the load when a user or object exerts a force on the strap 108, and because the entire ratchet mechanism 518 is wider than the pawl teeth, this load can be transferred to the upper wall 606 of the head 106 in a substantially straight line. This design including the wider ratchet mechanism 518 can therefore prevent the head 106, and particularly the walls 602, 604, 606 of the head 106, from deforming in an undesirable way when forces are applied during use. Moreover, as shown in FIGS. 5C-5E and 6C-6E, tab 520 also adds strength to the design and prevents the head 106 and its walls 602, 604, 606 from undesirably deforming. In particular, tab 520 can extend from and add thickness to the upper wall 606, thereby making it more difficult to deform upper wall 606, and thus the other walls 602, 604, when stresses are applied to the upper wall 606 through the ratchet mechanism 518 during use. This can be especially true since, as shown in FIG. 6E, tab 520 can align with the base 608 of ratchet mechanism 518 through the upper wall 606. The tab 520 can also provide a gripping surface for a user to grip the head 106, thereby making the design more ergonomic. In some embodiments with a smaller or no tab 520, the upper wall 606 of the head 106 can be thicker than the other walls 602, 604 to add strength.

Figure 11:
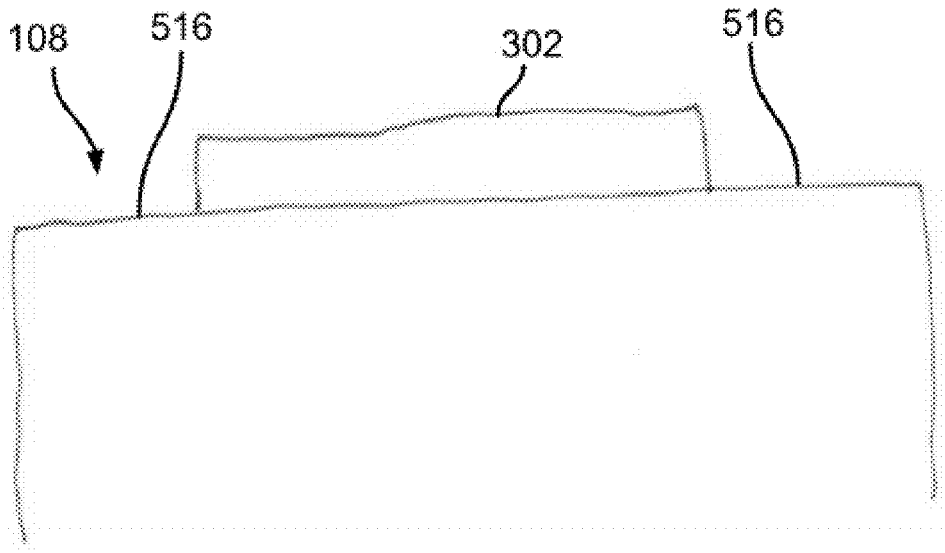
FIG. 11 depicts a cross section of a portion of a strap, including a substantially rectangular grip, of a tie apparatus of the present technology.
Figure 12:
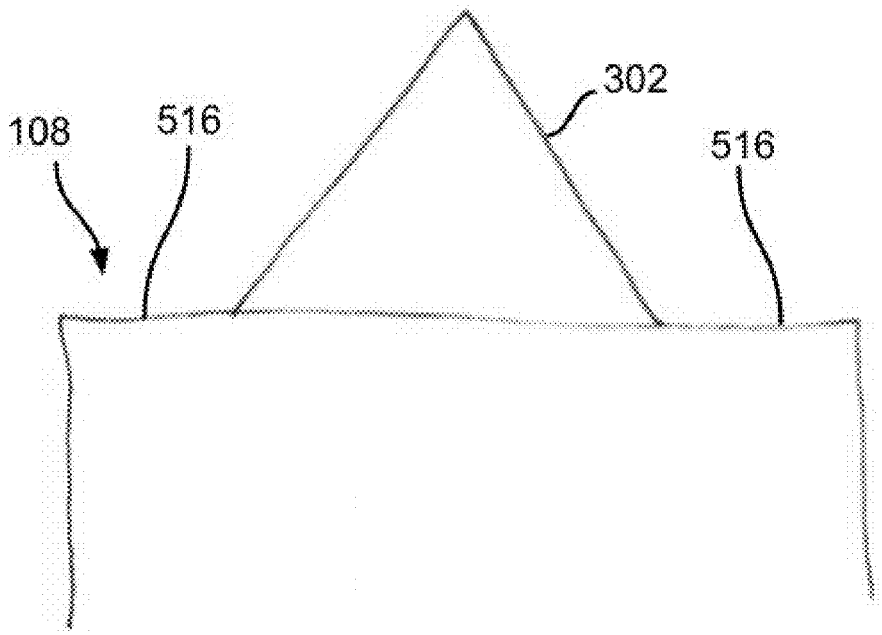
FIG. 12 depicts a cross section of a portion of a strap, including a substantially triangular grip, of a tie apparatus of the present technology.
Figure 13:
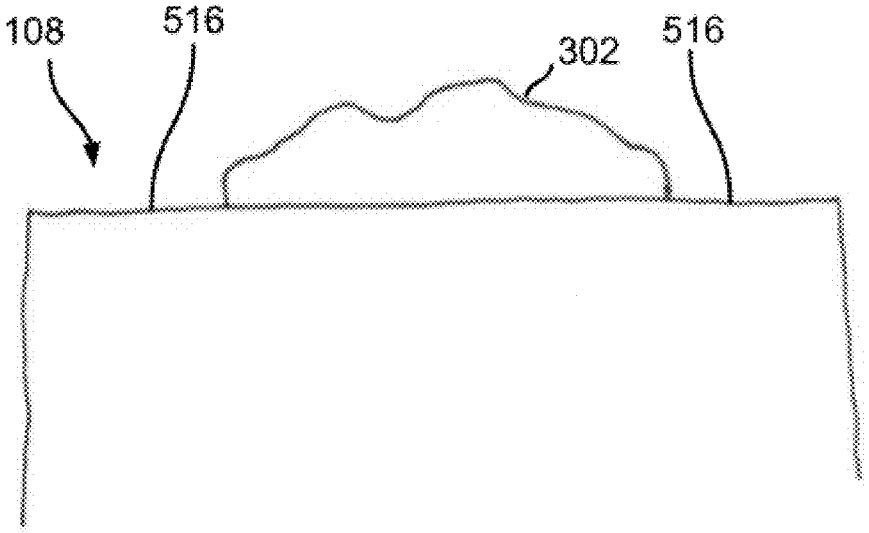
FIGS. 13 and 14 depict cross sections of portions of straps, including substantially randomly shaped grips, of tie apparatus of the present technology.
Figure 14:
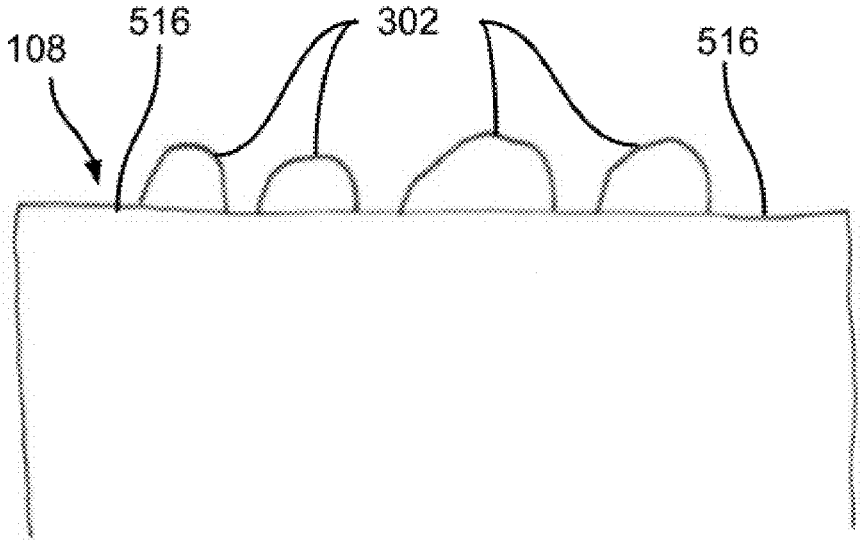

As shown in FIGS. 10-18, which are cross sectional views of part of the strap 108 in various embodiments, the grip 302 can have a variety of configurations. In some embodiments, as shown in FIGS. 3A-4B, 5B, 7, 8 and 10, the grip 302 can have a substantially semi-circular cross section. As shown in FIGS. 11 and 12, respectively, the grip 302 can also have substantially rectangular or triangular cross sections. As shown in FIGS. 13 and 14, the grip 302 can also have a cross section that is substantially random or that varies along its length. The random and/or varying cross section can be formed, for example, by applying the grip 302 as a glue or other adhesive or material that changes shape as it is placed on the strap 108 and/or sets. As shown in FIG. 14, in some embodiments, the grip 302 can have sections that, at a given cross section of the strap 108, are separate from other sections. This configuration can improve the gripping ability of the grip 302 in some circumstances, and can be formed by applying thin strands of grip 302 to the strap 108.

FIGS. 10-18 also show that lower landings 516 can provide a space between the outside edges of the grip 302 and the outside edges of the strap 108. In some embodiments, the width of the lower landings 516 and the grip 302 can be approximately equal. While in some embodiments, as shown for example in FIG. 10 (not to scale), the grip 302 can be approximately twice as wide as the lower landings 516. Moreover, the grip 302 can be centered on the width of the strap 108, but in some embodiments, it can be biased to one side of the strap or the other to increase gripping for a particular application. In some embodiments, it can be necessary for the lower landings 516 to have sufficient width so they can slide on the lower shoulders 506. In addition, it can be necessary for the grip 302 to be thin enough to slide through the channel 508 without substantially rubbing against the channel 508 walls (formed from lower shoulders 506).

The grip 302 can have a smooth surface, or can have a textured surface to increase friction. Moreover, in some embodiments, a plurality of grips 302 can be included on one strap 108. The grips 302 can be configured side-by-side, overlapping, end-to-end, or combinations thereof. For example, the long grip 302 shown in FIGS. 3A-4B, 9 and 10 can be replaced by a grip 302 with two, three, four, five or more sections, configured end-to-end, with space or notches in between each section.

Figure 15:
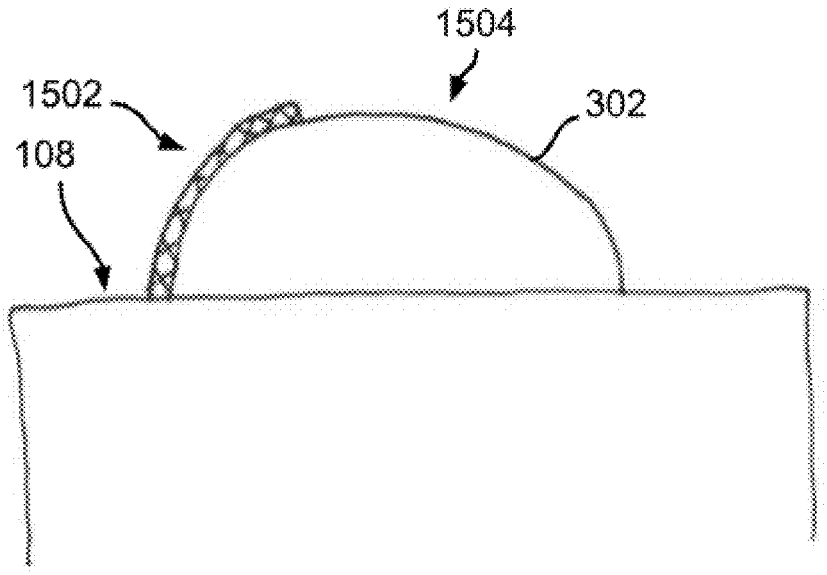
FIGS. 15 and 16 and depict cross sections of portions of straps, including grips with a coating on the grips, of tie apparatus of the present technology.
Figure 16:
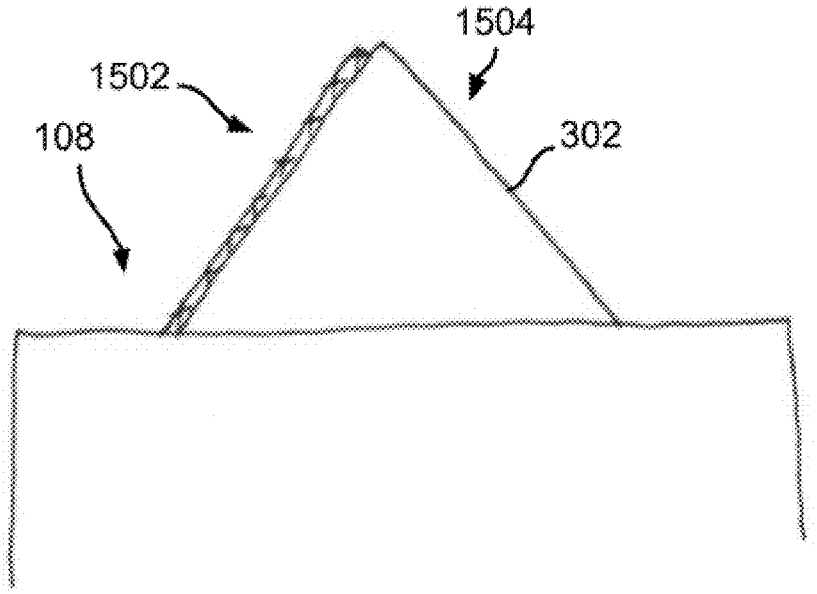
Figure 17A:
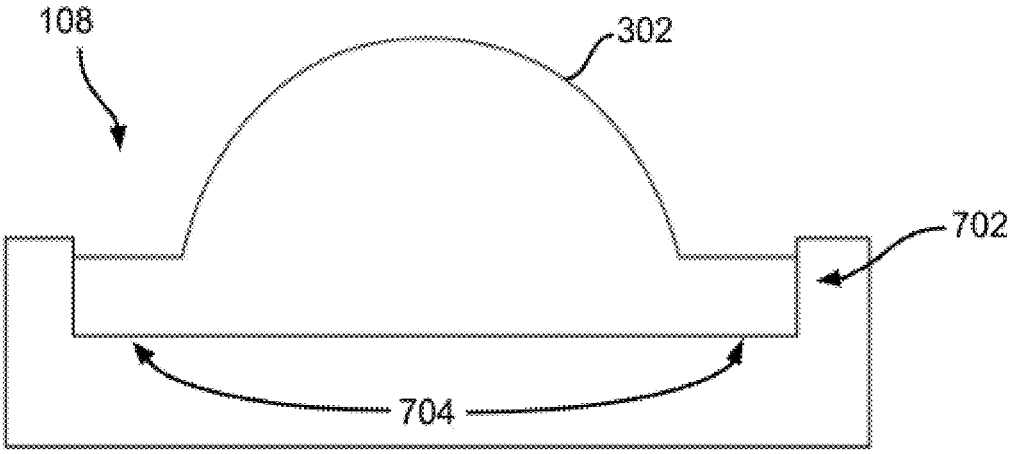
FIG. 17A depicts a cross section of a portion of a strap, including a cavity and a grip, of a tie apparatus of the present technology.
Figure 17B:
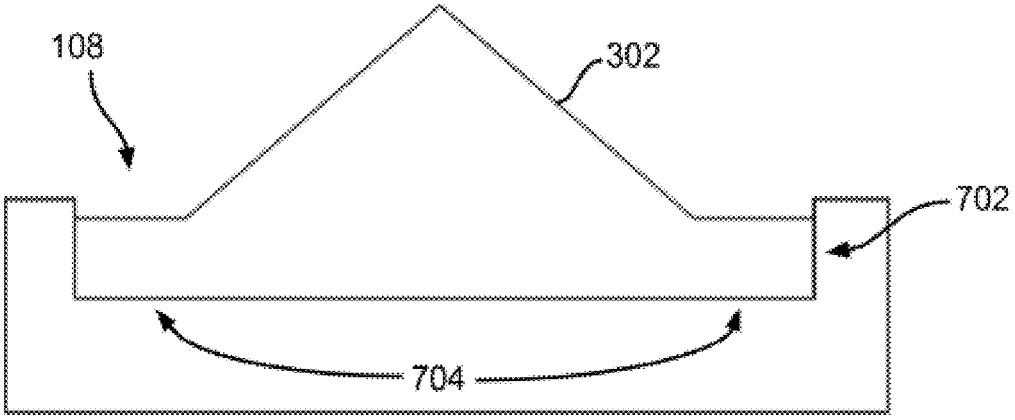
FIG. 17B depicts a cross section of a portion of a strap, including a cavity and a grip, of a tie apparatus of the present technology.

As shown in FIGS. 15 and 16, in some embodiments, the grip 302 can include a coating 1502. The coating can be disposed on all or some of the outer surface of the grip 302. In some embodiments, the coating 1502 can facilitate movement of the strap 108 on the objects being clinched by the tie apparatus 100 while the strap 108 is pulled through the head 106, and thus the tie apparatus 100 tightened. In other words, the coating 1502 can be more slippery than the rest of the grip 302. For example, as shown in FIGS. 15 and 16, the coating 1502 can be disposed on one surface or side of the grip 302. That surface can be in contact with the objects during tightening of the tie apparatus 100, but once the tie apparatus is tight, another or an additional surface 1504 of the grip 302 can be in contact with the objects. This can be accomplished, for example, by setting the tie apparatus 100 (by pushing the strap 108, for example) so that another surface 1504 of the grip 108, other than the surface with the coating 1502, is substantially in contact with the objects being clinched. Depending on the configuration of the strap 108 and the grip 302, the push or setting motion can be axial or rotational. These configurations can facilitate the process of clinching the gripped objects by providing a more slippery surface against the objects during installation, but these configurations can also provide an improved gripping surface after installation and locking/setting is complete.

Figure 4A:
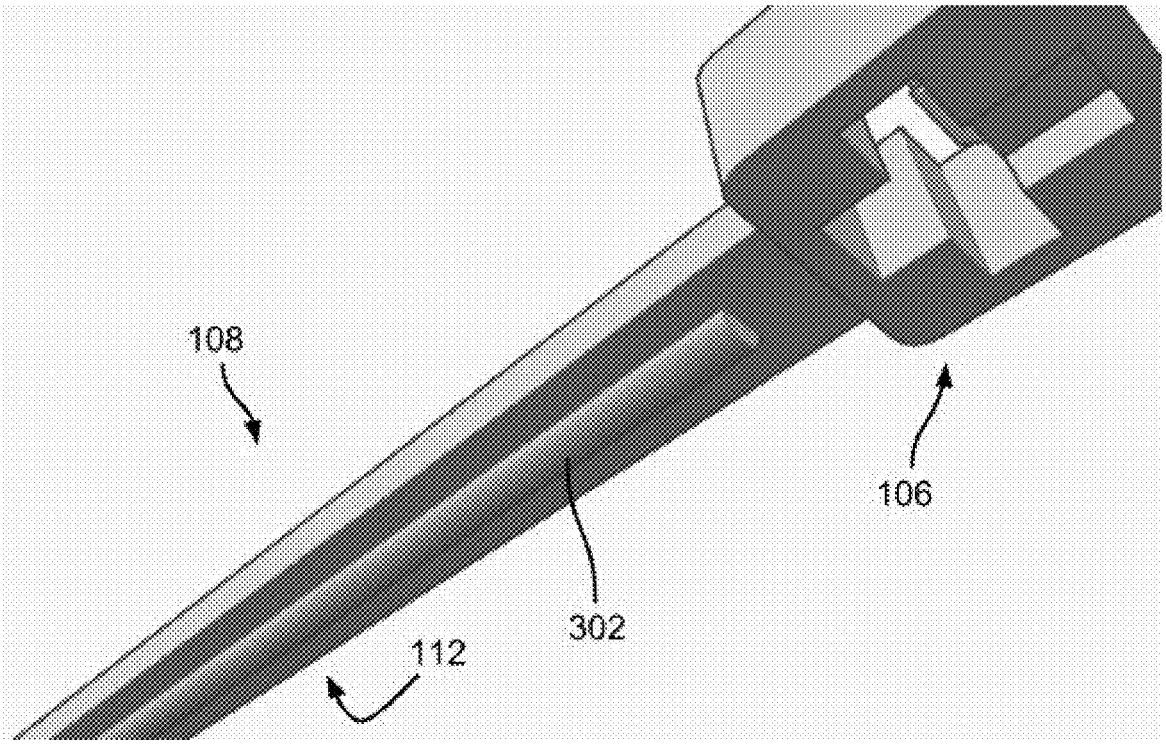
FIG. 4A depicts a bottom-rear perspective view of a head and strap (including a grip) of a tie apparatus of the present technology.
Figure 4B:
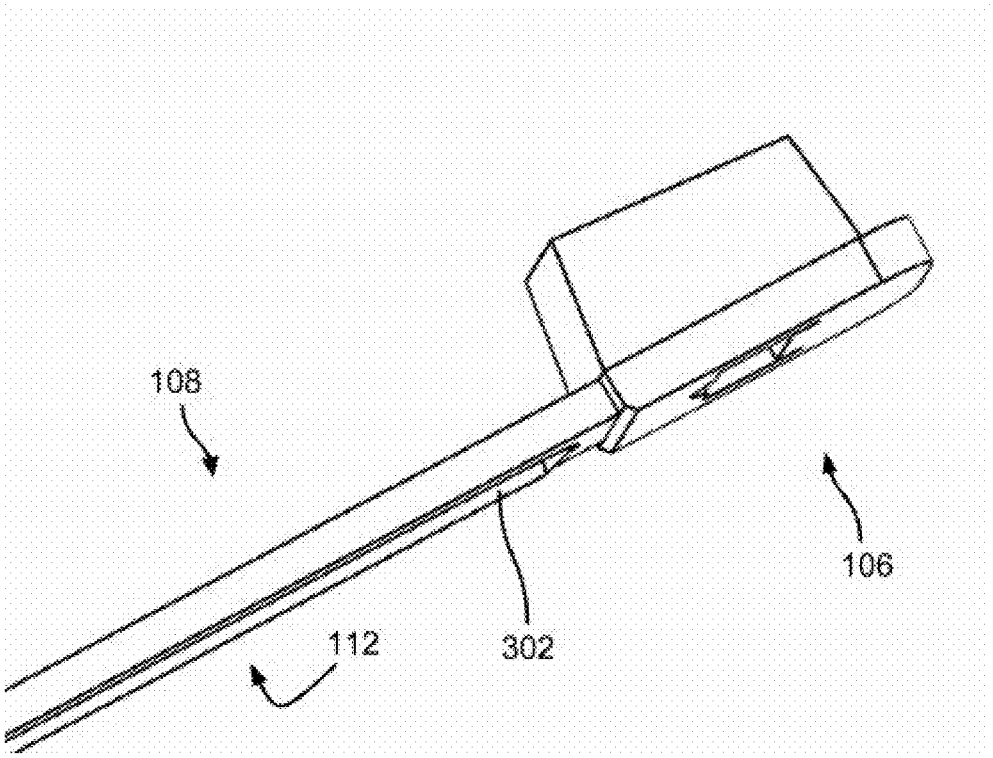
FIG. 4B depicts a side perspective view of a head and strap (including a grip) of a tie apparatus of the present technology.
Figure 5A:
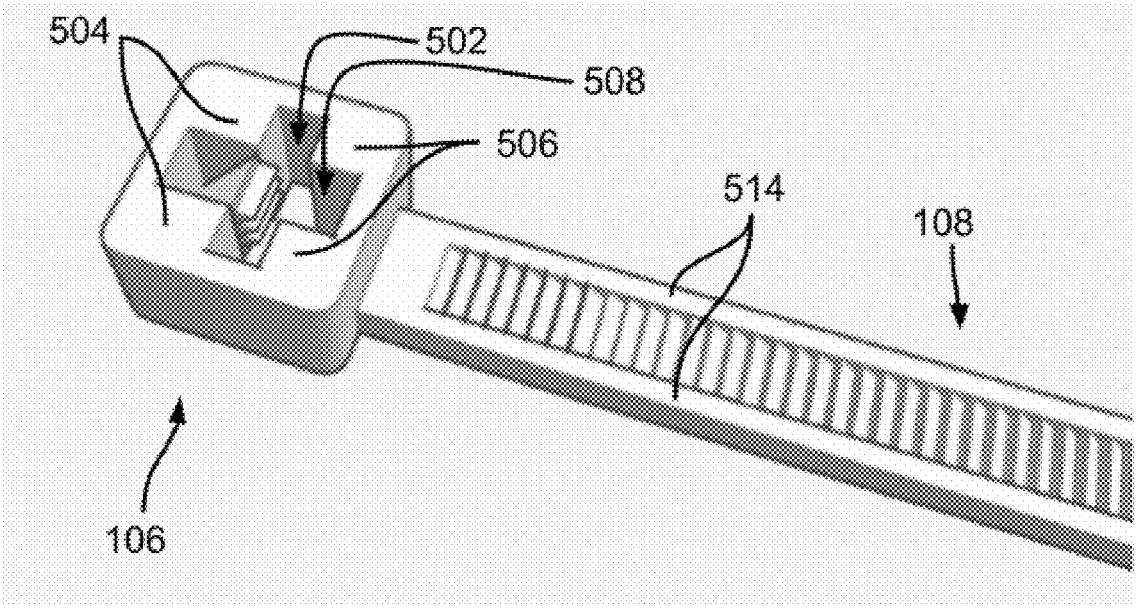
FIG. 5A depicts a top perspective view of a head and strap of a tie apparatus of the present technology.
Figure 5B:
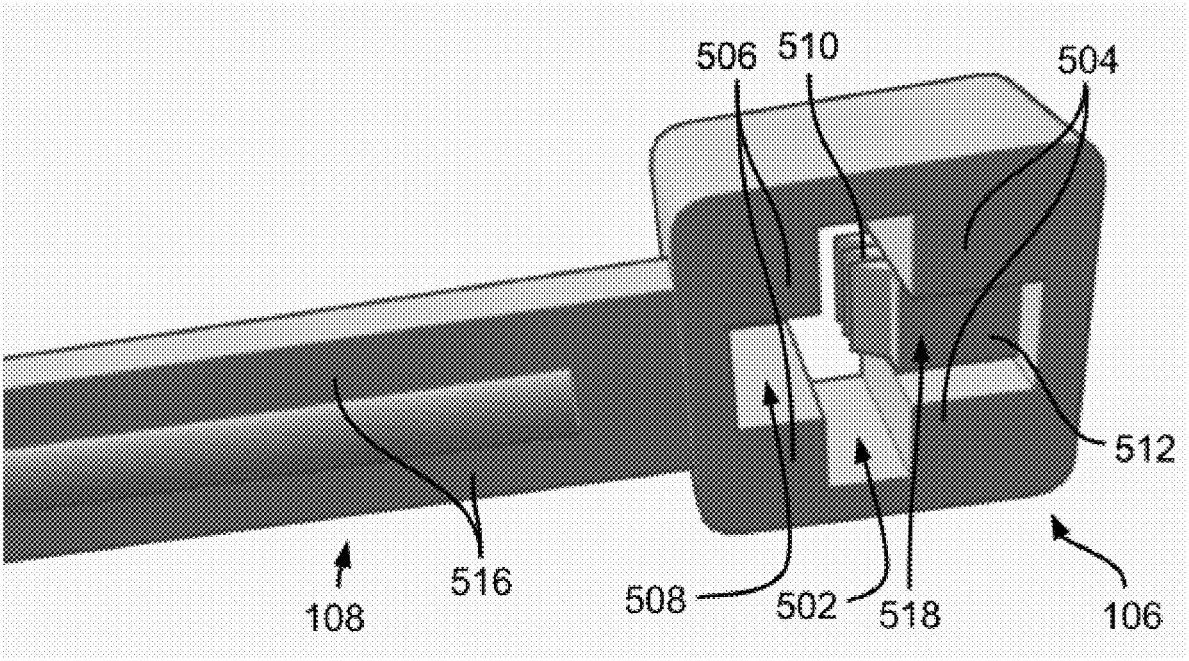
FIG. 5B depicts a bottom perspective view of a head and strap (including a grip) of a tie apparatus of the present technology.
Figure 5C:
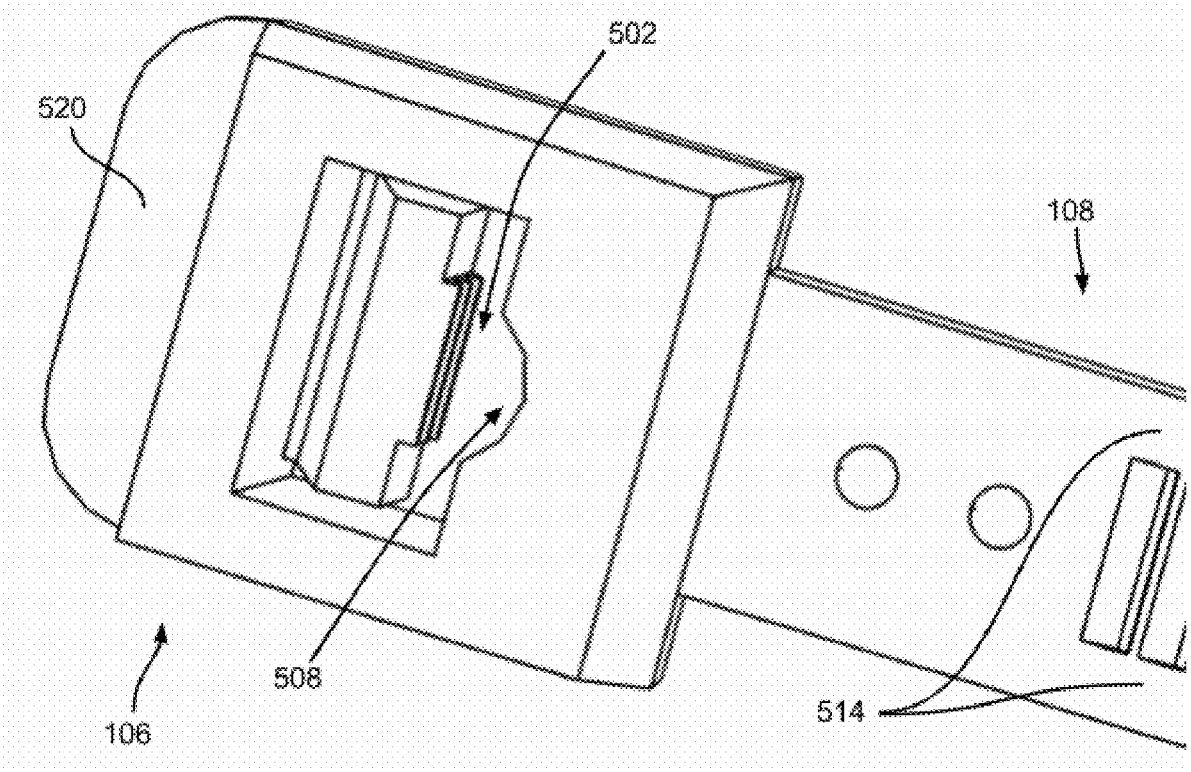
FIG. 5C depicts a top perspective view of a head and strap of a tie apparatus of the present technology.
Figure 5D:
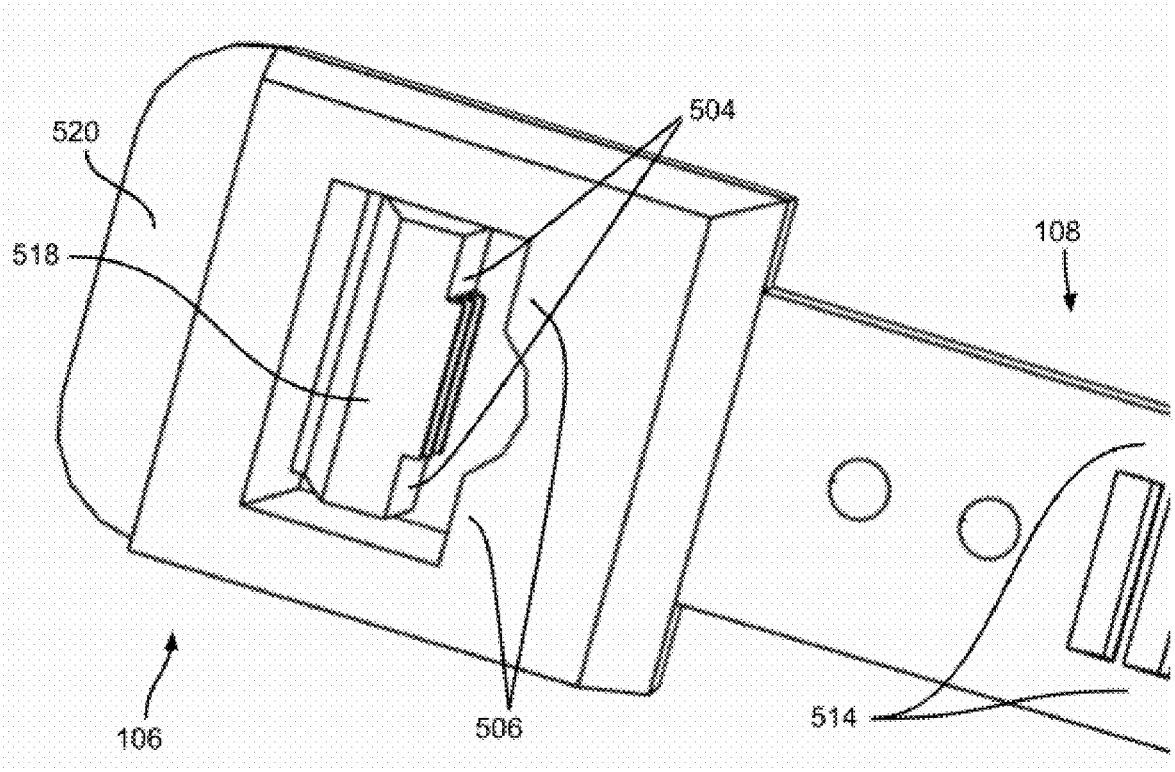
FIG. 5D depicts a top perspective view of a head and strap of a tie apparatus of the present technology.
Figure 5E:
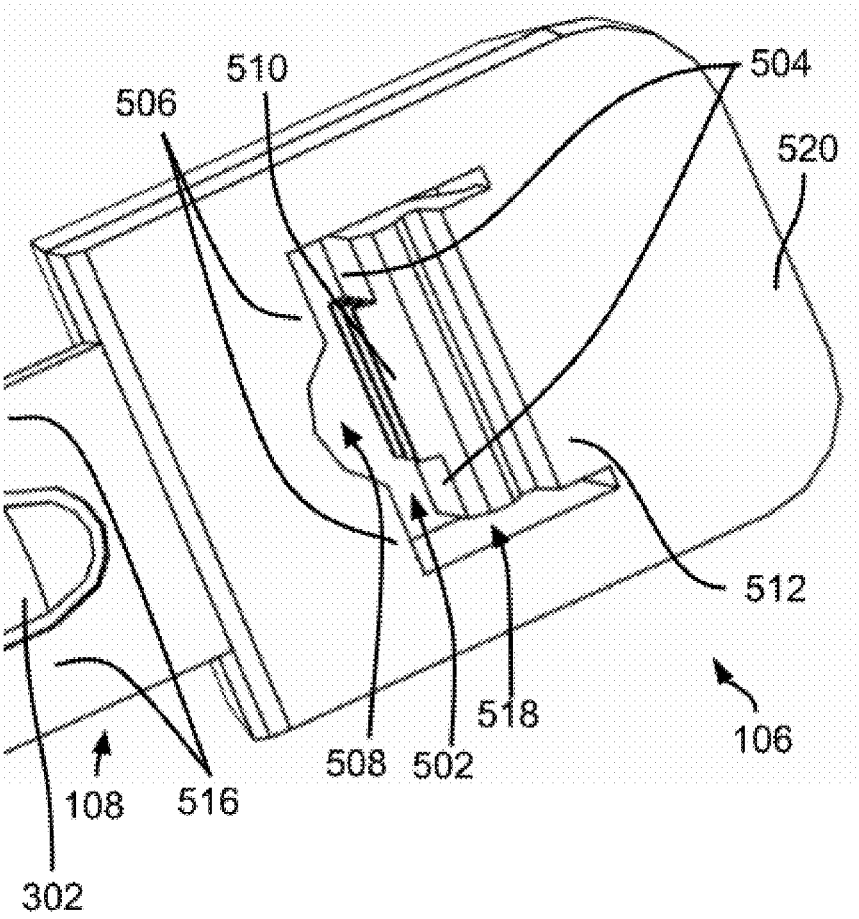
FIG. 5E depicts a bottom perspective view of a head and strap (including a grip) of a tie apparatus of the present technology.

Moreover, as shown in FIGS. 4A and 4B, for example, the grip 302 can be disposed on the strap 108. In some embodiments, the grip 302 can be a glue, a polymer, an adhesive, a foam, or another material that provides an increased coefficient of friction compared to conventional tie straps. In some embodiments, the grip 302 can be a thermoplastic elastomer. In some embodiments, the grip 302 can be made from silicon resin, such as a liquid silicon resin. In some embodiments, the grip 302 can be a hot melt adhesive such as, for example, hot glue. Thus, the grip 302 can be glued to the strap 108, or applied to the strap 108 in a liquid form and subsequently allowed to, or caused to, dry into a solid form. The grip 302 can also be mechanically connected to the strap 108, in addition to adhesively. The strap 108, and the head 106, can be made from a thermoplastic, such as nylon, or other suitable materials.

As shown in FIGS. 7-8 and 17A-19, the bottom 112 of the strap 108 can include a cavity 702. A portion of the grip 302 can be within the cavity 702, and a portion of the grip 302 can extend from the cavity 702. As shown, the cavity 702 can be a recess that extends into the strap 108. The cavity 702 can extend the same length, or slightly longer, as the grip 302 down the length of the strap 108. In some embodiments, the cavity 702 can provide protection for the edges of the grip 302 by harboring them in a groove, thereby substantially preventing the edges from rubbing against and being peeled back by other objects when the tie apparatus 100 is in use. This can help ensure the grip 302 does not become detached from the strap 108.

Figure 18A:
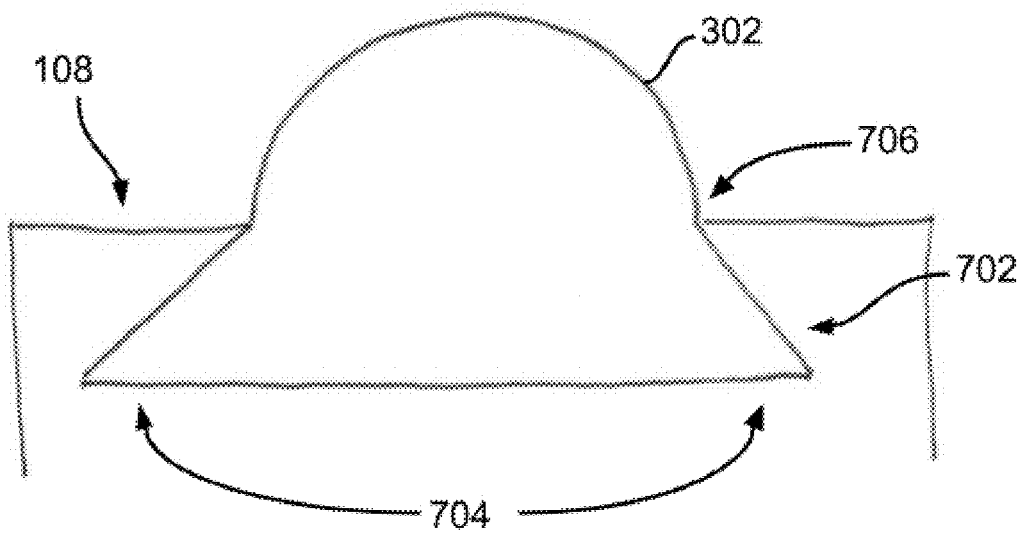
FIG. 18A depicts a cross section of a portion of a strap, including a cavity and a grip, of a tie apparatus of the present technology.
Figure 18B:
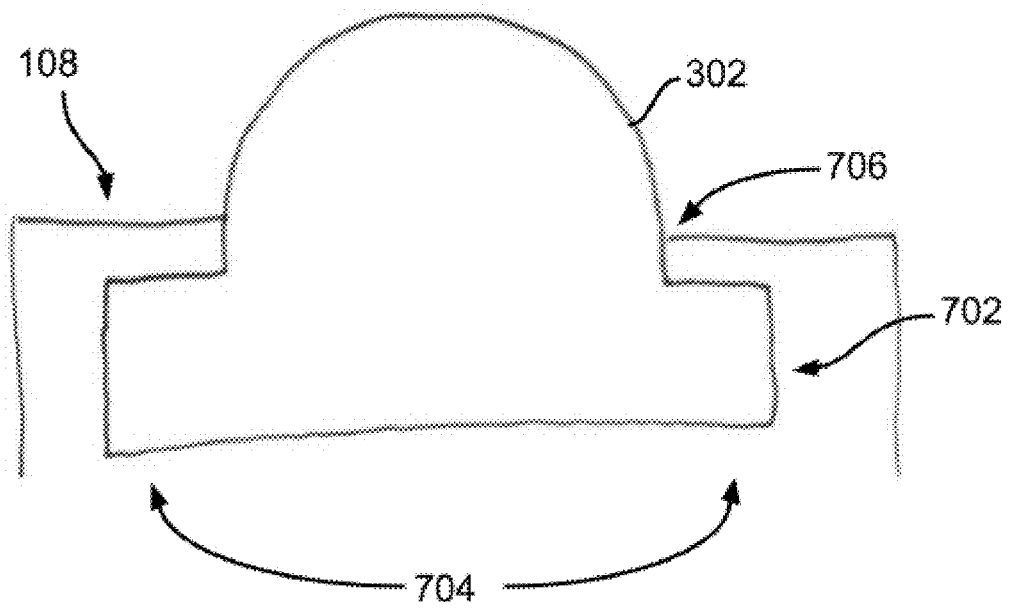
FIG. 18B depicts a cross section of a portion of a strap, including a cavity and a grip, of a tie apparatus of the present technology.

As shown in FIGS. 18A and 18B, in some embodiments, the cavity 702 can be sized and shaped to make it even more difficult for the grip 702 to separate from the strap 108. This can be accomplished, for example, by adhering the grip 302 to the inside walls of the cavity 702, as could happen if the grip 302 included an adhesive or was molded into place. Moreover, in some embodiments, the cavity 702 can have wings 704 that are wider than the top or entrance 706 of the cavity 702. These wings 704, which can be filled with grip 302 material, can substantially prevent the grip 302 from escaping the cavity 702 because the grip 302 can be too wide to fit out the entrance 706. As shown, the wings 704 can have a variety of configurations, such as angled (FIG. 17) or rectangle (FIG. 18).

Figure 19:
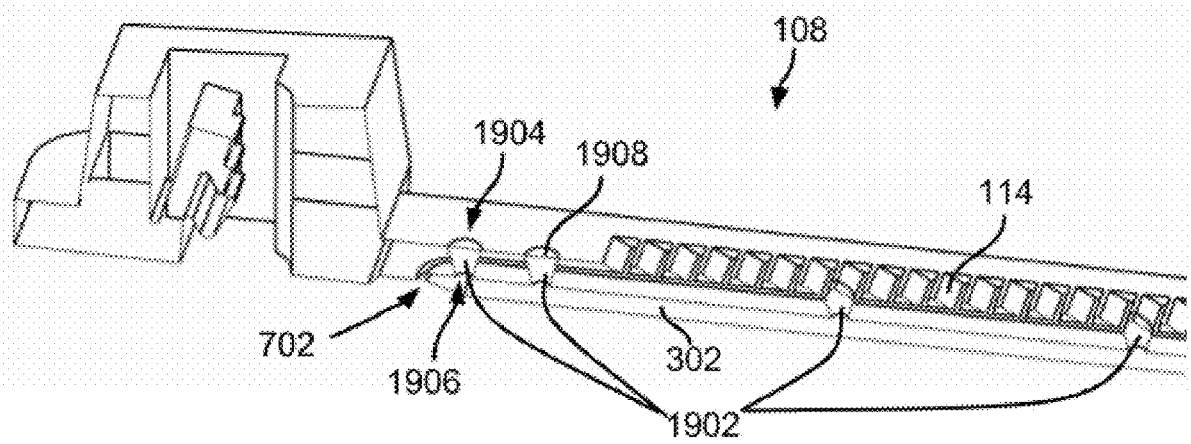
FIG. 19 depicts a cross sectional, side perspective view of a head and strap of a tie apparatus of the present technology.

In addition, as shown in FIG. 19, for example, the strap 108 can have a plurality of holes 1902 along its length, and as shown, those holes 1902 can have different dimensions at their respective ends. For example, as shown, the holes 1902 can have larger dimensions at the top-side-end 1904 than at the bottom-side-end 1906. The grip 302 can have corresponding tabs 1908 that extend into and substantially fill the holes 1902. The shape of the holes 1902 and the tabs 1908 can thus provide a mechanical connection between the grip 302 and the strap 108, since the shapes will make it difficult to pull the grip 302 away from the strap 108 because it will be difficult to pull the tabs 1908 through the holes 1902. This can help to decrease the chance that the grip 302 becomes detached from the strap 108. In some embodiments, the lateral ends of the grip 302 can have a high concentration of tabs 1902 and corresponding holes 1908 to help increase the mechanical connection in these areas. In addition, as shown, the holes 1908 can extend all the way through the strap 108. Alternatively, the holes 1908 can extend only part way into the strap 108 so that the top-side-end 1904 is inside of the strap 108.

Embodiments of the present technology also include methods of making a tie apparatus 100. In some embodiments, the tie apparatus 100 can be molded. More specifically, the tie apparatus 100 can be injection molded, and even more specifically, it can be co-injection molded or overmolded.

Figure 20:
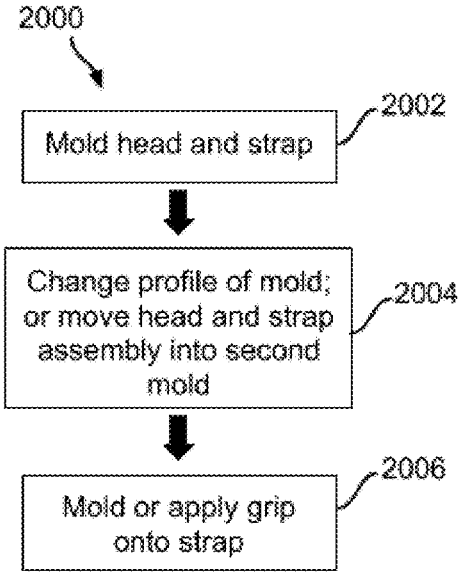
FIG. 20 depicts a flow chart including a method of making a tie apparatus of the present technology.

With reference to FIG. 20, a method 2000 of making a tie apparatus 100 is set forth. As shown, the head 106 and the strap 108 of the tie apparatus 100, without the grip 302, can be injection molded in step 2002. Subsequently, in step 2006, the grip 302 can be molded onto the strap 108 to form the embodiments described herein. After the grip 302 is formed, any texturing of the grip 302 can be done and any coatings can be applied.

To facilitate this process, the molding can be performed in a mold with a changeable profile, or in two molds, in step 2004. Accordingly, in some embodiments, the profile of mold the mold can change, for example, the mold can have a removable or retractable section. Thus, in use, once the head 106 and the strap 108 of tie apparatus 100 are molded, the removable or retractable section can be removed or retracted, as applicable. In some embodiments, after removal or rectraction, the grip 302 can be molded using the remaining portions of the mold. In other embodiments, such as embodiments including a staged mold, the removable or retractable section can replaced with another section of mold that provides a molding area for the grip 302. The grip 302 can then be molded onto the strap 108. Thus, as described, the molding can be carried out with one mold having a changeable profile. In other embodiments, however, the head 106 and the strap 108 can be removed after being molded and subsequently placed in a second mold where the grip 302 can be molded onto the strap 108.

While the present technology has been described in connection with a plurality of exemplary aspects, as illustrated in the various figures and discussed above, it is understood that other similar aspects can be used or modifications and additions made to the described aspects to perform the same or similar functions without deviating from the present technology. Other equivalent apparatus, methods and composition to the described are also contemplated by the teachings herein. Therefore, the present disclosure should not be limited to any single aspect, but rather construed in breadth and scope in accordance with the appended claims.

What is claimed is:

1. A tie apparatus comprising:

a strap, the strap comprising a top side and a bottom side, the top side having one or more ratchet teeth and the bottom side having a grip, the strap further comprising a cavity extending into the strap, and at least a portion of the grip disposed in the cavity, the grip configured to increase friction between the strap and one or more objects engaged by the tie apparatus; and a head, the head having:

a lower side, the strap extending from the lower side of the head, and lower shoulders of the lower side of the head defining a channel between them; and an upper side opposite the lower side, a ratchet mechanism extending from the upper side of the head, the ratchet mechanism having one or more pawl teeth to engage one or more of the ratchet teeth to secure the strap with the head.

2. The tie apparatus of claim 1, the ratchet mechanism extending from the upper side of the head into a slot for receiving the strap.

3. The tie apparatus of claim 1, wherein the strap slides through the head in a first direction, but the engagement of the pawl teeth and the ratchet teeth substantially prevents the strap from sliding through the head in the opposite direction.

4. The tie apparatus of claim 3, wherein the grip moves through the channel as the strap slides through the head.

5. The tie apparatus of claim 3, the head further comprising upper shoulders, and wherein the lower shoulders and the uppers shoulders maintain the strap to maintain engagement of the pawl teeth and the ratchet teeth.

6. The tie apparatus of claim 1, the upper side of the head comprising an upper wall, the upper wall having a tab extending therefrom, the tab aligned with a base of the ratchet mechanism.

7. The tie apparatus of claim 1, the cavity having wings that are wider than an entrance of the cavity.

8. The tie apparatus of claim 1, the strap having a plurality of holes along its length, the holes having different dimensions at their ends, and the grip having a plurality of tabs along its length, and wherein the tabs extend into and substantially fill the holes.

9. A tie apparatus comprising:

a strap, the strap comprising a top side and a bottom side, the bottom side having a grip and smooth lower landings on opposing sides of the grip, the strap further comprising a cavity extending into the strap, and at least a portion of the grip disposed in the cavity, the grip configured to increase friction between the strap and one or more objects engaged by the tie apparatus; and a head the strap can slide through, the strap extending from a lower side of the head, the head having a channel to receive the grip when the strap slides through the head, the channel disposed between lower shoulders of the lower side of the head, and wherein the smooth lower landings slide on the lower shoulders when the strap slides through the head.

10. The tie apparatus of claim 9, the head having a ratchet mechanism extending from an upper side of the head, the ratchet mechanism configured to engage the top side of the strap.

11. The tie apparatus of claim 10, wherein the strap slides through the head in a first direction but is prevented from sliding through the head in an opposite direction.

12. The tie apparatus of claim 10, the head further comprising upper shoulders, and wherein the lower shoulders and the uppers shoulders maintain the strap to enable the ratchet mechanism to maintain engagement with the top side of the strap when the strap slides through the head.

13. The tie apparatus of claim 9, wherein the grip extends most of the length of the strap.

14. A tie apparatus comprising:

a strap having a grip on a first side and ratchet teeth on a second side, the strap also having a cavity extending into the strap, at least a portion of the grip disposed in the cavity and at least a portion of the grip protruding from the cavity;

a head including a channel, the head configured to receive and secure the strap, the strap extending from a lower side of the head and the channel disposed between lower shoulders of the head;

wherein when the strap is received and secured by the head, the strap forms a loop with the grip facing an inside of the loop and the ratchet teeth facing an outside of the loop.

15. The tie apparatus of claim 14, wherein the perimeter of the loop is adjustable.

16. The tie apparatus of claim 14, the head having a ratchet mechanism extending from an upper side of the head, the ratchet mechanism having one or more pawl teeth to engage one or more of the ratchet teeth when the head receives and secures the strap.

17. The tie apparatus of claim 16, the head further comprising upper shoulders, and wherein the lower shoulders and the uppers shoulders maintain the strap to maintain engagement of the pawl teeth and the ratchet teeth.

18. The tie apparatus of claim 17, wherein the upper shoulders are part of the ratchet mechanism, and wherein the entire ratchet mechanism is wider than the pawl teeth.

19. The tie apparatus of claim 14, the head comprising a slot to receive the strap and wherein the channel receives the grip when the head receives and secures the strap.

20. The tie apparatus of claim 14, the grip having a higher coefficient of friction than the rest of the strap.

* * * * *